US010458310B2

(12) United States Patent
Morita et al.

(10) Patent No.: US 10,458,310 B2
(45) Date of Patent: Oct. 29, 2019

(54) CONTROL DEVICE FOR INTERNAL COMBUSTION ENGINE

(75) Inventors: Yusuke Morita, Susono (JP); Motoichi Murakami, Gotemba (JP); Hiroshi Yaguchi, Susono (JP); Takeshi Kitayama, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 979 days.

(21) Appl. No.: 14/371,086

(22) PCT Filed: Feb. 6, 2012

(86) PCT No.: PCT/JP2012/052624

§ 371 (c)(1), (2), (4) Date: Jul. 8, 2014

(87) PCT Pub. No.: WO2013/118244

PCT Pub. Date: Aug. 15, 2013

(65) Prior Publication Data

US 2014/0360444 A1 Dec. 11, 2014

(51) Int. Cl.
*F01P 7/16* (2006.01)
*F02D 35/02* (2006.01)

(52) U.S. Cl.
CPC ..... *F01P 7/167* (2013.01); *F02D 35/025* (2013.01); *F02D 35/026* (2013.01); (Continued)

(58) Field of Classification Search
CPC ..... F01P 7/167; F01P 2025/31; F02D 35/025; F02D 35/026; F02D 2200/021; F02D 35/027; G01L 23/22; G01L 23/221
(Continued)

(56) References Cited

U.S. PATENT DOCUMENTS 5,970,949 A 10/1999 Iwade et al.
2003/0051692 A1* 3/2003 Mizutani ..... F02D 11/105 123/179.15

(Continued)

FOREIGN PATENT DOCUMENTS

JP 6090934 A 5/1985
JP 4148030 A 5/1992

(Continued)

*Primary Examiner* — Lindsay M Low
*Assistant Examiner* — Omar Morales
(74) *Attorney, Agent, or Firm* — Sughrue Mion, PLLC

(57) ABSTRACT

An object of this invention is to suppress the occurrence of pre-ignition by appropriately controlling a wall surface temperature of a combustion chamber based on a target temperature region in which the frequency with which pre-ignition occurs is reflected, without causing pre-ignition to actually occur. An ECU 50 acquires a wall surface temperature of a combustion chamber 14 or an engine water temperature or the like that correlates therewith as a wall temperature parameter. The ECU 50 is equipped with data for a pre-ignition suppression temperature region that is a region in which the pre-ignition occurrence frequency is smallest among temperature regions of the wall temperature parameter. In a pre-ignition susceptibility operating region A, the wall temperature parameter is controlled so as to fall within the pre-ignition suppression temperature region by operating a cooling water amount varying mechanism 38.

8 Claims, 12 Drawing Sheets

(52) U.S. Cl.
CPC ..... *F01P 2025/31* (2013.01); *F01P 2037/00* (2013.01); *F02D 2200/021* (2013.01)

(58) Field of Classification Search
USPC ..... 123/41.08
See application file for complete search history.

(56) References Cited

U.S. PATENT DOCUMENTS

| | | | | |
|---|---|---|---|---|
| 2009/0178405 | A1* | 7/2009 | Chadwell ..... | F02B 37/04 60/600 |
| 2011/0130979 | A1 | 6/2011 | Kumagai et al. | |

FOREIGN PATENT DOCUMENTS

| | | | |
|---|---|---|---|
| JP | 11-013512 | A | 1/1999 |
| JP | 1113521 | A | 1/1999 |
| JP | 11-036965 | A | 2/1999 |
| JP | 2001159348 | A | 6/2001 |
| JP | 2002-339780 | A | 11/2002 |
| JP | 2003-083127 | A | 3/2003 |
| JP | 2004-044543 | A | 2/2004 |
| JP | 2005-240723 | A | 9/2005 |
| JP | 2008215246 | A | 9/2008 |
| JP | 200947014 | A | 3/2009 |
| JP | 2009-068363 | A | 4/2009 |
| JP | 200985199 | A | 4/2009 |
| JP | 2011-208540 | A | 10/2011 |
| WO | 2010134150 | A1 | 11/2010 |

* cited by examiner

CONTROL DEVICE FOR INTERNAL COMBUSTION ENGINE

CROSS REFERENCE TO RELATED APPLICATIONS

This application is a National Stage of International Application No. PCT/JP2012/052624, filed Feb. 6, 2012, the contents of all of which are incorporated herein by reference in their entirety.

TECHNICAL FIELD

The present invention relates to a control device for an internal combustion engine, and more particularly to a control device for an internal combustion engine that executes control that addresses pre-ignition (self-ignition before ignition).

BACKGROUND ART

As disclosed, for example, in Patent Literature 1 (Japanese Patent Laid-Open No. 11-36965), the conventional technology includes a control device for an internal combustion engine that includes a function that detects the occurrence of pre-ignition based on a temperature inside a combustion chamber (a wall surface temperature).

The applicants are aware of the following literature, which includes the above described literature, as literature related to the present invention.

CITATION LIST

Patent Literature

Patent Literature 1: Japanese Patent Laid-Open No. 11-36965

Patent Literature 2: Japanese Patent Laid-Open No. 2003-83127

Patent Literature 3: Japanese Patent Laid-Open No. 2004-44543

Patent Literature 4: Japanese Patent Laid-Open No. 2005-240723

Patent Literature 5: Japanese Patent Laid-Open No. 11-13512

SUMMARY OF INVENTION

Technical Problem

According to the aforementioned conventional technology, although the occurrence of pre-ignition can be detected based on a wall surface temperature of a combustion chamber, there is the problem that even when the wall surface temperature is in a state that is liable to induce pre-ignition, the conventional technology cannot effectively eliminate such a state. In particular, in the case of an engine with a supercharger, since pre-ignition is liable to occur in a low-rotation and high-load region, control that effectively avoids the occurrence of pre-ignition is required. That is, there is room for improvement in the conventional technology with respect to control that optimizes a wall surface temperature of a combustion chamber so that pre-ignition does not occur.

The present invention has been conceived to solve the above described problem, and an object of the present invention is to provide a control device for an internal combustion engine that, without actually causing pre-ignition to occur, can appropriately control a wall surface temperature of a combustion chamber based on a target temperature region in which a pre-ignition occurrence frequency is reflected, and thereby suppress the occurrence of pre-ignition.

Means for Solving the Problem

A first aspect of the present invention is a control device for internal combustion engine, comprising:

wall temperature parameter acquisition means for acquiring a cylinder wall temperature of an internal combustion engine or a parameter corresponding to the cylinder wall temperature as a wall temperature parameter;

cylinder wall temperature varying means that is capable of changing the cylinder wall temperature;

pre-ignition temperature region storage means in which a pre-ignition suppression temperature region in which a pre-ignition occurrence frequency decreases more than in a peripheral temperature region is previously stored, the pre-ignition suppression temperature region being a temperature region that is set based on a relation between a pre-ignition occurrence frequency and the cylinder wall temperature; and cylinder wall temperature control means for, in a case where an actual operating region that is a region in which the internal combustion engine is actually operating is within a predetermined pre-ignition susceptibility operating region, performing control using the cylinder wall temperature varying means so that the wall temperature parameter falls within the pre-ignition suppression temperature region.

A second aspect of the present invention, wherein:

the cylinder wall temperature varying means comprises a cooling water amount varying mechanism that adjusts a cooling water amount that is supplied to the internal combustion engine; and the cylinder wall temperature control means is configured so that, in a case where the wall temperature parameter deviates from the pre-ignition suppression temperature region, the cylinder wall temperature control means causes the wall temperature parameter to fall within the pre-ignition suppression temperature region by changing the cooling water amount using the cooling water amount varying mechanism.

A third aspect of the present invention, further comprising:

pre-ignition suppression means for, in a case where the wall temperature parameter deviates from the pre-ignition suppression temperature region in a state in which the actual operating region is within the pre-ignition susceptibility operating region, changing an operating state of the internal combustion engine to suppress occurrence of pre-ignition.

A fourth aspect of the present invention, further comprising:

delay means for, in a case where the pre-ignition suppression means first operates after cold starting of the internal combustion engine, delaying an operation start timing of the pre-ignition suppression means in a manner such that the higher that the wall temperature parameter is at a time point at which the actual operating region enters the pre-ignition susceptibility operating region, the more that the operation start timing is delayed.

A fifth aspect of the present invention, further comprising:

pre-ignition detection means for detecting an occurrence of pre-ignition; and delay correction means for, in a case where pre-ignition occurs before operation of the pre-ignition suppression means starts, correcting a relation between the wall temperature parameter and the operation start timing so that the operation start timing becomes earlier.

A sixth aspect of the present invention, further comprising:

occurrence frequency detection means for detecting an occurrence frequency that is a frequency at which pre-ignition occurs per unit of time; and temperature region varying means for variably setting a range of the pre-ignition suppression temperature region in a case where the pre-ignition occurrence frequency exceeds a permissible limit.

A seventh aspect of the present invention, further comprising:

a supercharger that supercharges intake air utilizing an exhaust pressure;

wherein the pre-ignition susceptibility operating region is a low-rotation and high-load region.

Advantageous Effects of Invention

According to the first invention, a wall temperature parameter such as a wall temperature parameter that is based on a target temperature region (pre-ignition suppression temperature region) which reflects a pre-ignition occurrence frequency can be appropriately controlled in a pre-ignition susceptibility operating region, and thus the occurrence of pre-ignition can be suppressed. More specifically, without causing pre-ignition to actually occur and without providing means for detecting such an occurrence, an effect that suppresses pre-ignition can be obtained merely by controlling the temperature of a wall temperature parameter. Accordingly, pre-ignition detection means can be omitted, and damage that the internal combustion engine receives as the result of pre-ignition occurring even temporarily can be suppressed to a minimum. It is thereby possible to protect the internal combustion engine from the occurrence of pre-ignition while simplifying the control system and sensor system of the internal combustion engine.

According to the second invention, in a low temperature region in which the wall temperature parameter is lower than a temperature lower limit value of the pre-ignition suppression temperature region, a cooling water amount of the internal combustion engine can be decreased by a cooling water amount varying mechanism. It is thereby possible to promptly raise the wall temperature parameter so as to fall within the pre-ignition suppression temperature region. On the other hand, when the wall temperature parameter is in a high temperature region that is higher than a temperature upper limit value of the pre-ignition suppression temperature region, a cooling water amount of the internal combustion engine can be increased to an amount that is greater than the normal cooling water amount by the cooling water amount varying mechanism. It is thereby possible to lower the wall temperature parameter so as to fall within the pre-ignition suppression temperature region.

According to the third invention, in a case where the wall temperature parameter is outside the pre-ignition suppression temperature region in a state in which the actual operating region of the internal combustion engine has entered the pre-ignition susceptibility operating region, the pre-ignition suppression means can change an operating state of the internal combustion engine to suppress the occurrence of pre-ignition. Accordingly, the pre-ignition suppression means can more reliably suppress the occurrence of pre-ignition through a synergistic effect obtained with the operations of the wall temperature parameter control means.

According to the fourth invention, in a case where pre-ignition suppression means first operates after cold starting of the internal combustion engine, the higher that the wall temperature parameter is at a time point at which the actual operating region enters the pre-ignition susceptibility operating region, the greater the degree to which an operation start timing of the pre-ignition suppression means can be delayed. That is, in a low temperature region, it is difficult for pre-ignition to occur if the wall temperature parameter is high, and hence a configuration is adopted so that the pre-ignition suppression control means is caused to operate as little as possible (the pre-ignition suppression control means is actuated at a late timing). On the other hand, when the wall temperature parameter is low, since pre-ignition is liable to occur upon entering the pre-ignition susceptibility operating region, the pre-ignition suppression control means is actuated as early as possible. It is thereby possible to ensure the driving performance and exhaust emission performance of the internal combustion engine while suppressing the pre-ignition occurrence frequency.

According to the fifth invention, in a case where pre-ignition occurs before the start of operation of the pre-ignition suppression means, delay correction means can correct the relation between the relevant operation start timing and the wall temperature parameter to make the operation start timing earlier. Thus, the relation between the operation start timing of the pre-ignition suppression means and the wall temperature parameter can be learned based on a pre-ignition occurrence state.

According to the sixth invention, for example, even if the pre-ignition suppression temperature region in a base state (before correction) deviates from an optimal region due to changes in the fuel properties or changes over time in the pre-ignition occurrence frequency or the like, a temperature region after correction can be adjusted to the optimal region based on the actual pre-ignition occurrence frequency. Accordingly, the influence of a disturbance can be absorbed and the wall temperature parameter can be appropriately controlled. Furthermore, a pre-ignition suppression temperature region can be corrected taking only the pre-ignition occurrence frequency as a parameter and without using a special mechanism or sensor or the like for detecting changes over time in the fuel properties and engine characteristics, and hence the system can be simplified and a reduction in cost can be facilitated.

According to the seventh invention, in an internal combustion engine with a supercharger, even in a case where pre-ignition is liable to occur in a low-rotation and high-load region, the wall temperature parameter can be appropriately controlled so as to fall within the pre-ignition suppression temperature region, and thus the occurrence of pre-ignition can be suppressed.

BRIEF DESCRIPTION OF DRAWINGS

FIG. 12 is a characteristic diagram that illustrates a case in which, in Embodiment 3 of the present invention, the pre-ignition suppression temperature region is shifted to the low temperature side because of changes in the fuel properties or the like.

DESCRIPTION OF EMBODIMENTS

Embodiment 1

Configuration of Embodiment 1

Figure 1:
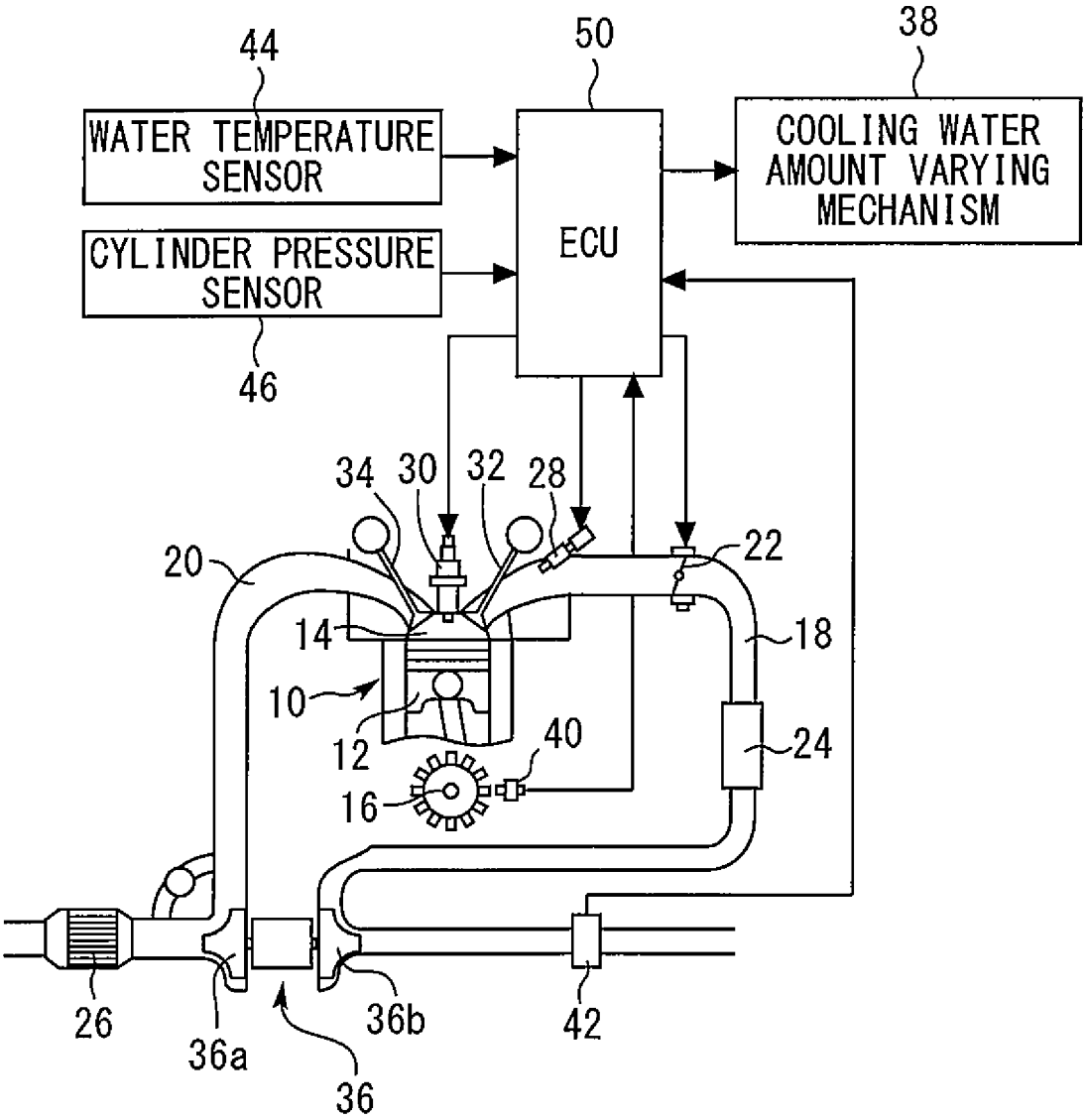
FIG. 1 is an overall configuration diagram for describing the system configuration of Embodiment 1 of the present invention.
Figure 8:
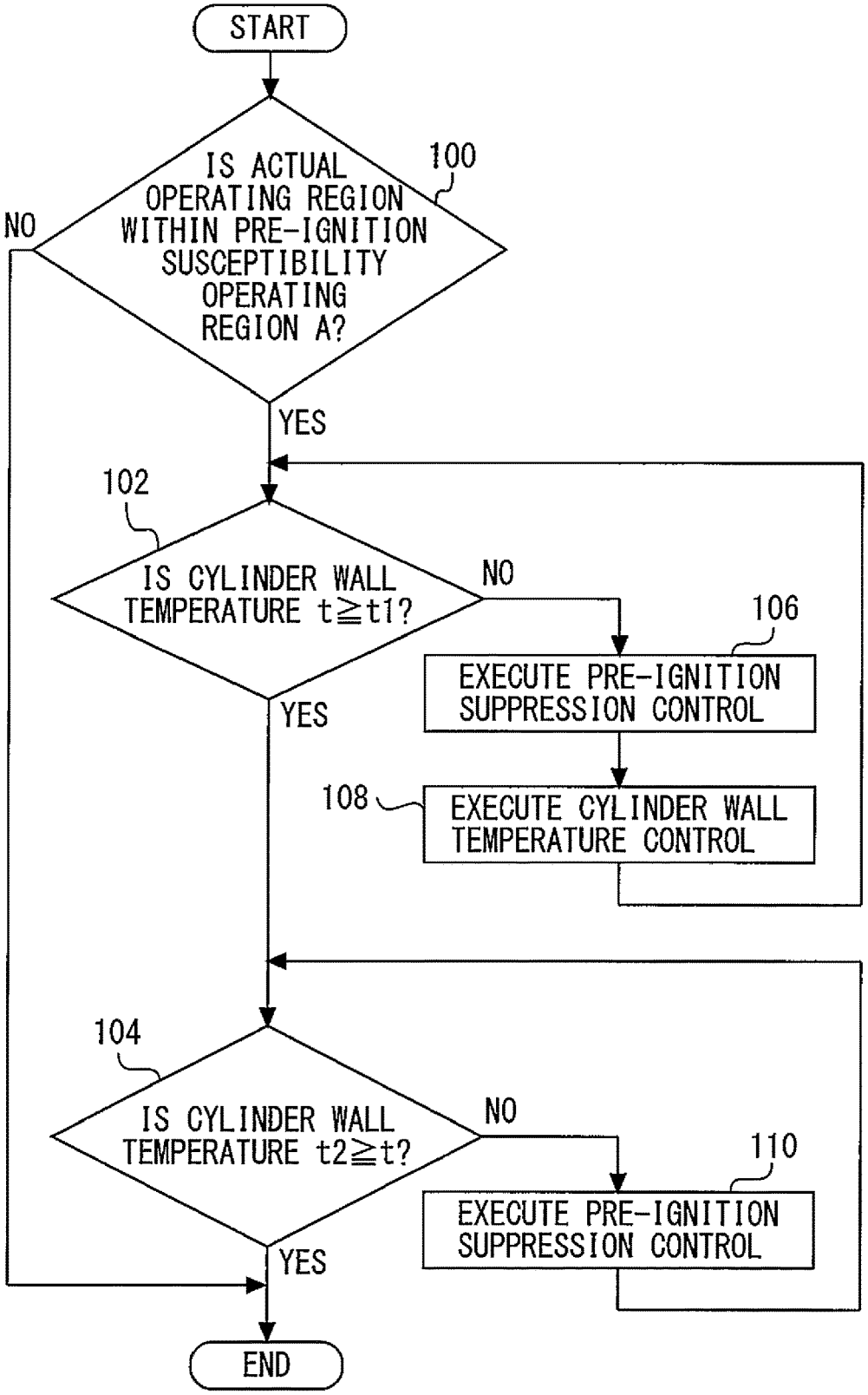
FIG. 8 is a flowchart that illustrates control that is executed by the ECU according to Embodiment 1 of the present invention.

Hereunder, Embodiment 1 of the present invention is described referring to FIG. 1 and FIG. 8. FIG. 1 is an overall configuration diagram for describing the system configuration of Embodiment 1 of the present invention. The system of the present embodiment includes an engine 10 as a multi-cylinder internal combustion engine. Note that only one cylinder of the engine 10 is illustrated in FIG. 1. The present invention is applied to an engine having an arbitrary number of cylinders, including an engine having a single cylinder. In each cylinder of the engine 10, a combustion chamber 14 is defined by a piston 12, and the piston 12 is connected to a crankshaft 16 of the engine. The engine 10 also includes an intake passage 18 that draws intake air into the combustion chamber 14 of each cylinder (into the cylinder), and an exhaust passage 20 through which exhaust gas is discharged from each cylinder.

An electronically controlled throttle valve 22 that adjusts an intake air amount based on a degree of accelerator opening or the like and an intercooler 24 that cools intake air are provided in the intake passage 18. An exhaust purification catalyst 26 such as a three-way catalyst that purifies exhaust gas is provided in the exhaust passage 20. Each cylinder is provided with a fuel injection valve 28 that injects fuel into an intake port, a spark plug 30 that ignites an air-fuel mixture in the cylinder, an intake valve 32 that opens and closes the intake port with respect to the inside of the cylinder, and an exhaust valve 34 that opens and closes an exhaust port with respect to the inside of the cylinder. The engine 10 also includes a known turbosupercharger 36 that supercharges intake air utilizing an exhaust pressure. The turbosupercharger 36 is constituted by a turbine **36*a* that is provided in the exhaust passage 20 on an upstream side of the exhaust purification catalyst 26, and a compressor 36*b* that is provided in the intake passage 18. When the turbosupercharger 36 operates, the turbine 36*a* receives an exhaust pressure and drives the compressor 36*b*, and as a result intake air is supercharged by the compressor 36*b***.

The system of the present embodiment also includes a cooling water amount varying mechanism 38 that adjusts an amount of engine cooling water (cooling water amount) that circulates between the engine 10 and a radiator (not illustrated). The cooling water amount varying mechanism 38 has a known configuration as disclosed, for example, in Japanese Patent Laid-Open No. 2005-240723 and Japanese Patent Laid-Open No. 11-13512, and includes a variable displacement pump that is disposed in an engine cooling water passage and a switching valve that switches channels for the cooling water and the like. The cooling water amount varying mechanism 38 is controlled by an ECU 50 that is described later, and constitutes cylinder wall temperature varying means that is capable of changing the wall surface temperature of the combustion chamber 14 (cylinder wall temperature) by increasing or decreasing the cooling water amount of the engine.

Next, the control system of the engine will be described. The system of the present embodiment includes a sensor system including sensors 40 to 46, and an ECU (Electronic Control Unit) 50 that controls an operating state of the engine 10. First, the sensor system will be described. A crank angle sensor 40 outputs a signal that is synchronous with rotation of the crankshaft 16. An airflow sensor 42 detects an intake air amount of the engine. A water temperature sensor 44 detects the temperature (engine water temperature tw) of the engine cooling water. The engine water temperature tw is used as a wall temperature parameter corresponding to a cylinder wall temperature t as described later, and the water temperature sensor 44 constitutes wall temperature parameter acquisition means of the present embodiment.

A cylinder pressure sensor 46 detects a cylinder pressure, and is provided in each cylinder. The cylinder pressure sensor 46 constitutes pre-ignition detection means for detecting the occurrence of pre-ignition as described later. The sensor system also includes various kinds of sensors that are required for control of the engine and vehicle (an air-fuel ratio sensor that detects the exhaust air-fuel ratio, and an accelerator sensor that detects an accelerator operation amount of a driver and the like). These sensors are connected to an input side of the ECU 50. On the other hand, various actuators including the throttle valve 22, the fuel injection valve 28, the spark plug 30, and the cooling water amount varying mechanism 38 are connected to an output side of the ECU 50.

The ECU 50, is constituted, for example, by an arithmetic processing apparatus that includes a storage circuit such as a ROM, a RAM, or a non-volatile memory, and an input/output port. The ECU 50 controls the operating state by driving the respective actuators while detecting information regarding operation of the engine by means of the sensor system. More specifically, the ECU 50 detects the number of engine revolutions (engine rotational speed) and the crank angle based on an output of the crank angle sensor 40, and calculates an intake air amount based on the output of the airflow sensor 42. The ECU 50 also calculates a load state (load factor) of the engine based on the intake air amount and the number of engine revolutions and the like. The ECU 50 determines the fuel injection timing and the ignition timing based on the crank angle, and drives the fuel injection valve 28 or the spark plug 30 when these timings are reached. Thus, an air-fuel mixture inside the cylinders can be burned to operate the engine.

Features of Embodiment 1

Figure 2:
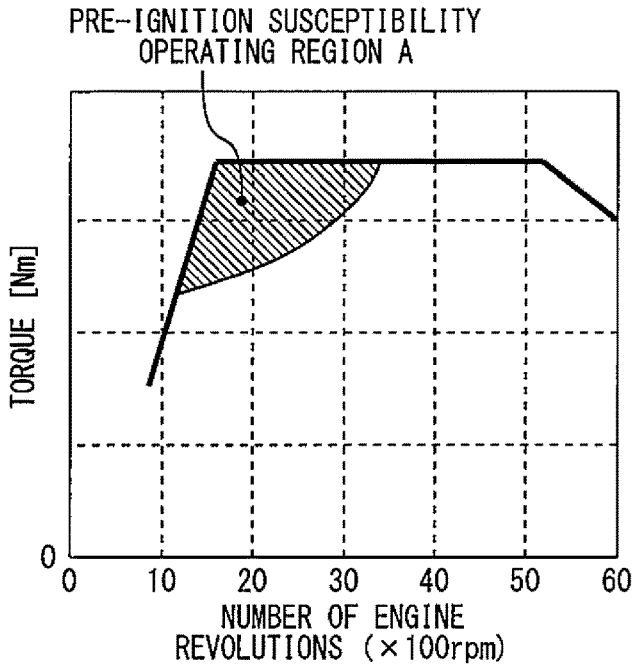
FIG. 2 is an explanatory drawing that illustrates a pre-ignition susceptibility operating region A.
Figure 3:
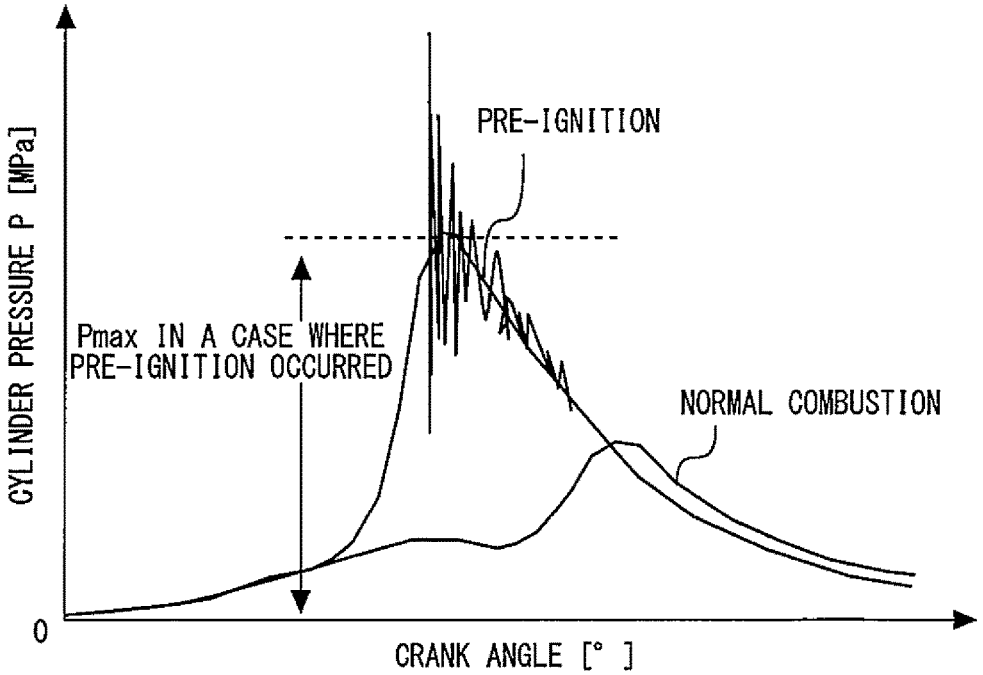
FIG. 3 is a characteristic diagram illustrating a cylinder pressure in a case where pre-ignition occurred.

First, a tendency for pre-ignition to occur in, for example, an engine with a supercharger will be described referring to FIG. 2 and FIG. 3. FIG. 2 is an explanatory drawing that illustrates a pre-ignition susceptibility operating region A. FIG. 3 is a characteristic diagram illustrating a cylinder pressure in a case where pre-ignition occurred. As illustrated in FIG. 2, in an engine with a supercharger, for example, within an operating region that is defined in accordance with the number of engine revolutions and torque, pre-ignition is liable to occur in a low-rotation and high-load region. In a case where pre-ignition occurred, as shown in FIG. 3, in comparison to a time of normal combustion, a maximum cylinder pressure (Pmax) and a cylinder temperature become extremely high, and hence components of the engine are liable to be adversely affected. Note that, the term "low-rotation and high-load region" refers, for example, to an operating region in which torque is a level between 60 and 70% or more of the maximum output thereof, and the number of engine revolutions is a level between 40 and 50% or less of the maximum number of revolutions. According to the present embodiment, the following control is described taking a low-rotation and high-load region of an engine with a supercharger as an example of the pre-ignition susceptibility operating region A.

Figure 4:
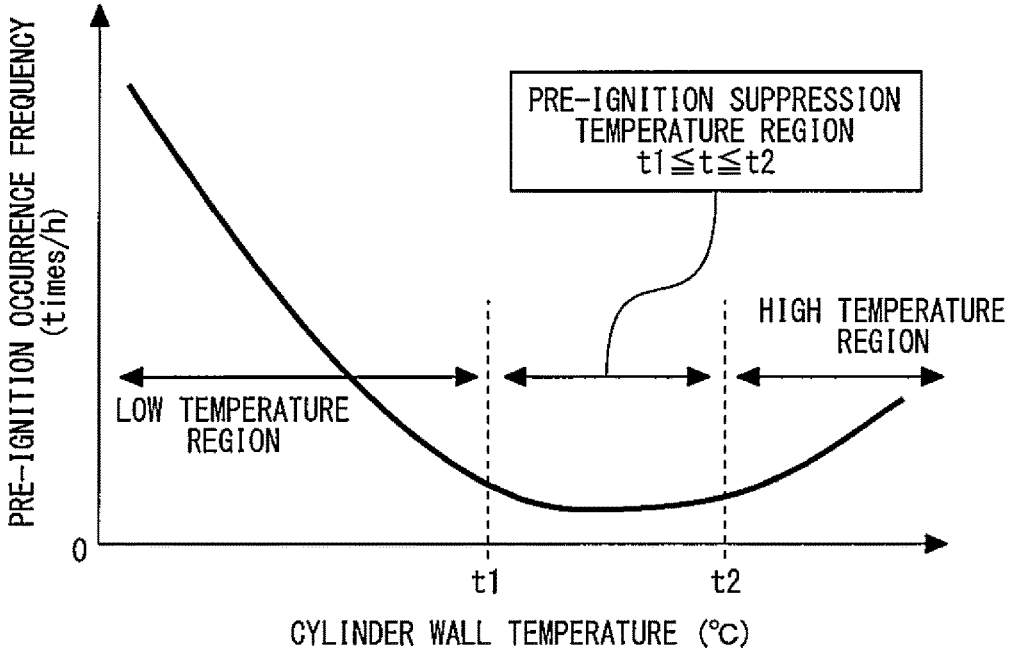
FIG. 4 is a characteristic diagram illustrating the relation between a pre-ignition occurrence frequency and a cylinder wall temperature in the pre-ignition susceptibility operating region A.

FIG. 4 is a characteristic diagram illustrating the relation between a pre-ignition occurrence frequency and a cylinder wall temperature in the pre-ignition susceptibility operating region A. As shown in FIG. 4, the applicants of the present application found that the pre-ignition occurrence frequency (number of occurrences per unit time) is lowest when a cylinder wall temperature t remains between a predetermined temperature lower limit value t1 and a temperature upper limit value t2. In the following description, a temperature region ($t1 \leq t \leq t2$) of the cylinder wall temperature in which the pre-ignition occurrence frequency is lowest in this manner is referred to as "pre-ignition suppression temperature region". It is considered that the reason the pre-ignition suppression temperature region arises is as follows.

First, during operation of the engine, remaining oil that is not scraped by a piston that performs a reciprocating movement in the cylinder is liable to accumulate in a crevice of the piston. Consequently, if the oil dilution ratio (ratio at which injected fuel mixes in the oil) increases, the oil viscosity will decrease and oil droplets are liable to scatter inside the cylinder. The scattered oil droplets serve as a fire source and cause pre-ignition to occur. In this case, in a low temperature region ($t<t1$) in which the cylinder wall temperature t is lower than the temperature lower limit value t1, since it is basically difficult for injected fuel to evaporate, there is a tendency for the oil dilution ratio to increase and consequently pre-ignition is liable to occur. However, if the cylinder wall temperature t increases from this state, it is easier for the fuel to evaporate and the oil dilution ratio decreases, and hence it is difficult for oil droplets to scatter and consequently the fire sources decrease and it becomes difficult for pre-ignition to occur. That is, in the low temperature region, the pre-ignition occurrence frequency decreases as the cylinder wall temperature t increases towards the pre-ignition suppression temperature region.

On the other hand, in a high temperature region ($t>t2$) in which the cylinder wall temperature t is higher than the temperature upper limit value t2, since the cylinder temperature increases accompanying an increase in the cylinder wall temperature, pre-ignition is liable to occur due to ignition caused by a high temperature. That is, in the high temperature region, the pre-ignition occurrence frequency increases as the cylinder wall temperature t increases from the pre-ignition suppression temperature region towards the high temperature side. Thus, the pre-ignition suppression temperature region has a characteristic such that the pre-ignition occurrence frequency decreases to a lower level than in the peripheral temperature regions, and is thus the optimal temperature region for suppressing pre-ignition. Therefore, according to the present embodiment, the cylinder wall temperature control described hereunder is executed. Note that, the specific range of the pre-ignition suppression temperature region (the temperature lower limit value t1 and the temperature upper limit value t2) is obtained by experiment and the like.

(Cylinder Wall Temperature Control)

Figure 5:
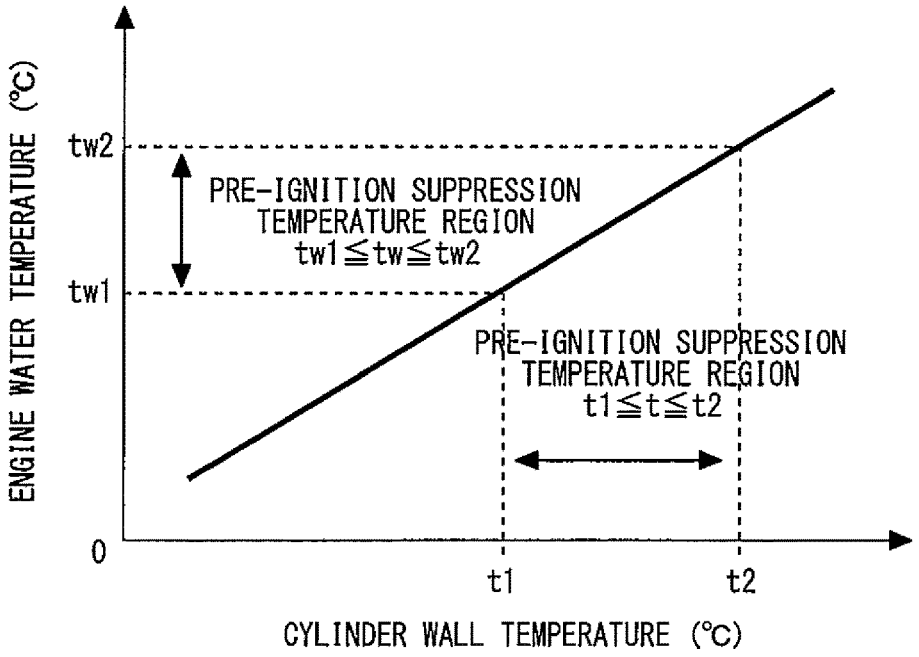
FIG. 5 is a characteristic diagram illustrating a data map obtained by converting the relation between the cylinder wall temperature and the engine water temperature into data format.

According to the cylinder wall temperature control, in a case where the region in which the engine is actually operating (hereunder, referred to as "actual operating region") enters the pre-ignition susceptibility operating region A, the cooling water amount of the engine is changed using the cooling water amount varying mechanism 38, and the cylinder wall temperature t is controlled so as to fall in the pre-ignition suppression temperature region ($t1 \leq t \leq t2$). More specifically, first, data that defines the pre-ignition suppression temperature region (data for the characteristic lines shown in FIG. 4, or at least the temperature lower limit value t1 and the temperature upper limit value t2) is stored in advance in the ECU 50 that constitutes pre-ignition temperature region storage means of the present embodiment. Further, a data map (see FIG. 5) obtained by converting the relation between the cylinder wall temperature t and the engine water temperature tw into data format is also stored in advance in the ECU 50. The ECU 50 calculates the cylinder wall temperature t on the basis of the engine water temperature tw based on the data map, and for example, in a case where the cylinder wall temperature t is lower than the temperature lower limit value t1, the ECU 50 controls the cooling water amount varying mechanism 38 to decrease the cooling water amount of the engine to an amount that is less than the normal cooling water amount.

Figure 6:
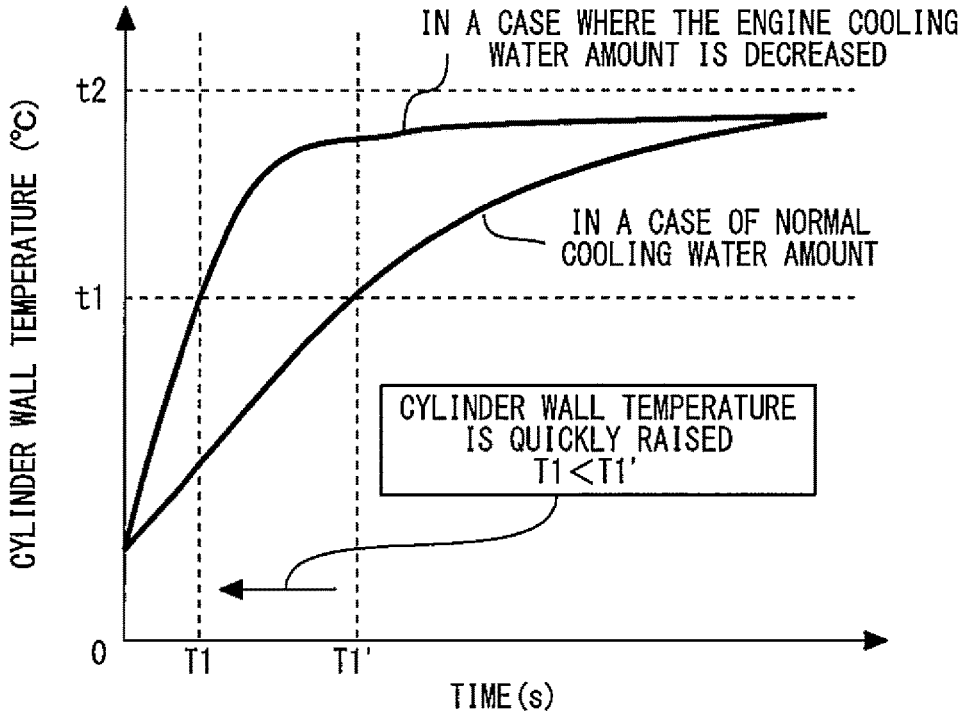
FIG. 6 is a characteristic diagram that illustrates the manner in which, in the low temperature region, the rate of increase in the cylinder wall temperature changes in accordance with a cooling water amount of the engine.

FIG. 6 is a characteristic diagram that illustrates the manner in which, in the low temperature region, the rate of increase in the cylinder wall temperature changes in accordance with a cooling water amount of the engine. In this case, a normal cooling water amount corresponds to, for example, a cooling water amount when the cylinder wall temperature control is not executed. In a case where the engine cooling water amount is decreased, as in the example shown in FIG. 6, the time required for the cylinder wall temperature t to reach the temperature lower limit value t1 is reduced from T1' to T1. Therefore, in the low temperature region, the cylinder wall temperature t can be quickly raised so as to be brought into the pre-ignition suppression temperature region.

On the other hand, in a case where the cylinder wall temperature t is in a high temperature region that is higher than the temperature upper limit value t2, the cooling water amount varying mechanism 38 is controlled so as to increase the engine cooling water amount to an amount that is greater than the normal cooling water amount. As a result, the cooling efficiency of the engine can be raised to decrease the cylinder wall temperature t so as to fall within the pre-ignition suppression temperature region. Therefore, according to the cylinder wall temperature control, in a case where the actual operating region of the engine has entered the pre-ignition susceptibility operating region A, even if the cylinder wall temperature t has deviated to either of the low temperature side and the high temperature side from the pre-ignition suppression temperature region, the cylinder wall temperature t can be caused to shift so as to fall within the pre-ignition suppression temperature region by the cooling water amount varying mechanism 38.

Thus, according to the present embodiment, in the pre-ignition susceptibility operating region A, the cylinder wall temperature t can be appropriately controlled based on the target temperature region (pre-ignition suppression temperature region) which reflects the pre-ignition occurrence frequency, and thus the occurrence of pre-ignition can be suppressed. That is, even without causing pre-ignition to actually occur and without providing means for detecting the occurrence of pre-ignition, an effect of suppressing pre-ignition can be obtained by merely controlling the cylinder wall temperature t. Accordingly, pre-ignition detection means can be omitted, and damage that the engine receives due to pre-ignition occurring even temporarily can be suppressed to a minimum. It is thereby possible to protect the engine from pre-ignition while simplifying the control system and sensor system of the engine.

Further, according to the present embodiment, a special temperature detection apparatus or the like for detecting the cylinder wall temperature t is not used, and instead the cylinder wall temperature t is acquired based on the engine water temperature tw, and the cylinder wall temperature t can be easily controlled by means of the engine water temperature tw. More specifically, utilizing the characteristics data shown in FIG. 5, the temperature lower limit value t1 and the temperature upper limit value t2 of the cylinder wall temperature shown in FIG. 4 and FIG. 6 are converted in advance into a temperature lower limit value tw1 and a temperature upper limit value tw2 of the engine water temperature. According to this configuration, in the cylinder wall temperature control, by controlling the engine water temperature tw so as to fall within a pre-ignition suppression temperature region ($tw1 \leq tw \leq tw2$), the same actions and effects as in the aforementioned case can be obtained.

In the case of using the engine water temperature tw as a control parameter in this manner, the existing water temperature sensor 44 can be utilized, and since special cylinder wall temperature detection means is not required, the sensor system can be simplified and a reduction in cost can be facilitated. Note that, in the following description, including the description of other embodiments, cases of controlling the cylinder wall temperature t that is determined based on the engine water temperature tw are exemplified. However, in these cases also, a configuration may also be adopted in which cylinder wall temperatures t1 and t2 are converted in advance into the engine water temperatures tw1 and tw2, and the engine water temperature tw is controlled.

(Pre-Ignition Suppression Control)

As described in the foregoing, the cylinder wall surface control can efficiently suppress pre-ignition. However, according to the present embodiment, a configuration may be adopted that executes pre-ignition suppression control in order to increase the pre-ignition suppressing effect in a state in which the cylinder wall temperature t deviates from the pre-ignition suppression temperature region. Known control such as air-fuel ratio enrichment control or torque reduction (output reduction) control may be used as the pre-ignition suppression control. As one example, the air-fuel ratio enrichment control is control that utilizes latent heat of fuel vaporization to lower the cylinder temperature and suppress the occurrence of pre-ignition.

Figure 7:
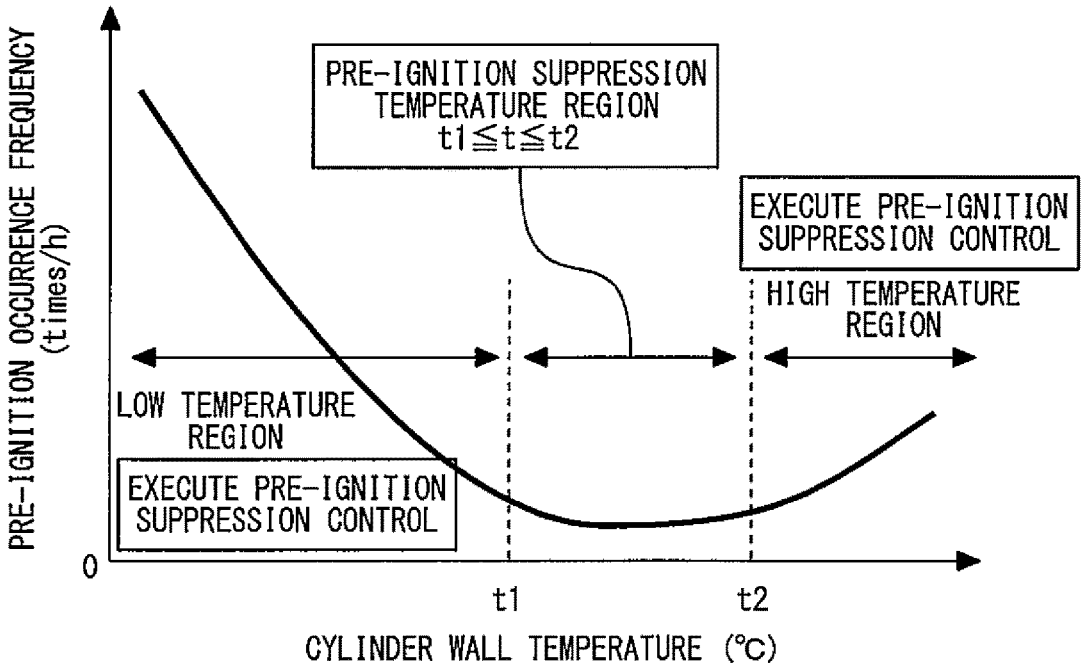
FIG. 7 is an explanatory diagram that illustrates a pre-ignition suppression control execution region.

FIG. 7 is an explanatory diagram that illustrates a pre-ignition suppression control execution region. The pre-ignition suppression control is executed in a case where, in a state in which the actual operating region of the engine has entered the pre-ignition susceptibility operating region A, the cylinder wall temperature t deviates from the pre-ignition suppression temperature region (that is, when the cylinder wall temperature t entered the aforementioned low temperature region or high temperature region). The pre-ignition suppression control changes the operating state (operation parameters) of the engine to suppress the occurrence of pre-ignition. The ignition timing, fuel injection amount and injection timing, ignition timing, intake air amount, and valve timing of the intake valve or exhaust valve and the like may be mentioned as examples of the operation parameters. The pre-ignition suppression control is executed during a period from when the actual operating region of the engine enters the pre-ignition susceptibility operating region A until the cylinder wall temperature t falls within the pre-ignition suppression temperature region as a result of the cylinder wall temperature control, and the pre-ignition suppression control is stopped when the cylinder wall temperature t is within the pre-ignition suppression temperature region.

As described above, the pre-ignition suppression control is executed in both of the low temperature region and the high temperature region. It is thereby possible to suppress the occurrence of pre-ignition by means of the pre-ignition suppression control while rapidly increasing the cylinder wall temperature by means of the cylinder wall temperature control in a case where the cylinder wall temperature t is in the low temperature region, for example, during a period from when the engine is cold-started until warming up of the engine is completed. Further, in a case where the cylinder wall temperature t is in a high temperature region also due to high output operations or a high temperature environment or the like, a pre-ignition suppression effect can be obtained in a substantially similar manner as in the case of the low temperature region. Accordingly, pre-ignition can be suppressed more reliably by the synergistic effect of cylinder wall temperature control and pre-ignition suppression control.

In many cases the highest value from a practical standpoint of the cylinder wall temperature t is determined mainly by the structural characteristics of the engine (for example, the positional relationship between the cylinders and the cooling water passage, and the cooling performance of the radiator) or a factor such as the ambient temperature environment. Further, there is a tendency for the temperature upper limit value t2 of the pre-ignition suppression temperature region to also be determined mainly by the structural factors of the engine. Accordingly, depending on these factors, in some cases it is difficult to decrease the temperature upper limit value t2 that has entered the high temperature region, by means of only cylinder wall temperature control that utilizes the cooling water amount. In such a case, it is preferable to, for example, appropriately design the structure of the engine or the like in advance so that the highest value of the cylinder wall temperature does not enter the high temperature region (or so that a state in which the cylinder wall temperature has entered the high temperature region becomes temporary). By constructing the engine in such a manner, since it is difficult for the cylinder wall temperature to enter the high temperature region, a configuration may also be adopted so that the cylinder wall temperature control is not executed in the high temperature region and only the pre-ignition suppression control is executed. Thus, substantially the same actions and effects as the present embodiment can be obtained.

Specific Processing to Realize Embodiment 1

Next, specific processing for implementing the above described control is described with reference to FIG. 8. FIG. 8 is a flowchart that illustrates control that is executed by the ECU according to Embodiment 1 of the present invention. It is assumed that the routine shown in FIG. 8 is repeatedly executed during operation of the engine. In the routine shown in FIG. 8, first, in step 100, the ECU 50 determines whether or not the actual operating region of the engine is in the pre-ignition susceptibility operating region A based on, for example, the number of engine revolutions and the load factor (torque). More specifically, in step 100, the ECU 50 determines that the engine is operating in the pre-ignition susceptibility operating region A in a case where the number of engine revolutions is equal to or less than a predetermined low revolutions determination value and the load is equal to or greater than a predetermined high-load determination value.

Next, in steps 102 and 104, first the ECU 50 calculates the cylinder wall temperature t based on the engine water temperature, and next the ECU 50 determines whether or not the cylinder wall temperature t belongs to stored data (temperature lower limit value t1 and temperature upper limit value t2) for the pre-ignition suppression temperature region that was previously stored in the ECU 50 in correspondence the pre-ignition occurrence frequency. More specifically, in step 102, the ECU 50 determines whether the cylinder wall temperature t is equal to or greater than the temperature lower limit value t1, and if the result of this determination is negative, it is presumed that the pre-ignition occurrence frequency has reached a high level that exceeds a permissible limit. Therefore, in this case, in step 106, the ECU 50 executes the aforementioned pre-ignition suppression control. Further, in step 108, the cooling water amount that circulates through the engine is reduced by the cooling water amount varying mechanism 38 to cause the cylinder wall temperature t to quickly increase.

On the other hand, even if the result determined in step 102 is affirmative, if the result determined in step 104 is negative, since the cylinder wall temperature t is higher than the temperature upper limit value t2, it is determined that pre-ignition is liable to occur, and therefore, in step 110, the ECU 50 executes the pre-ignition suppression control. Note that, in this case also, the cylinder wall temperature control may be executed to increase the cooling water amount that circulates through the engine by means of the cooling water amount varying mechanism 38 and thereby decrease the cylinder wall temperature t. In addition, if the results determined in both steps 102 and 104 are affirmative, since the cylinder wall temperature t is in the pre-ignition suppression temperature region, the ECU 50 determines that the relevant wall temperature is being appropriately controlled, and therefore ends the present control.

Note that, in the above described Embodiment 1, steps 102 and 104 in FIG. 8 represent a specific example of the pre-ignition temperature region storage means according to claim 1, and step 108 in FIG. 8 represents a specific example of cylinder wall temperature control means and also the cooling water amount varying mechanism according to claim 2. Further, steps 106 and 110 represent a specific example of pre-ignition suppression means according to claim 3.

Further, in the above described Embodiment 1, a configuration is adopted in which the pre-ignition suppression control and the cylinder wall surface control are appropriately used in accordance with whether or not the cylinder wall temperature is in the suppression temperature region in which pre-ignition is liable to occur or another temperature region. However, the present invention is not limited thereto and, for example, the operating region may be classified into a plurality of three or more regions in accordance with the ease with which pre-ignition occurs, and a degree of executing the pre-ignition suppression control or a flow rate of cooling water that is set by the cylinder wall surface control may be minutely controlled in accordance with the individual regions.

In the above described Embodiment 1, the engine water temperature is described as an example of a temperature parameter corresponding to the cylinder wall temperature (bore wall temperature). In this case, although it is not necessary to mount an apparatus that directly detects the cylinder wall temperature in the engine, and the system configuration can be simplified, the present invention is not limited thereto. That is, according to the present invention, a configuration may also be adopted that directly detects the wall temperature of a cylinder or a cylinder block, and a configuration may be adopted that uses the temperature of lubricating oil or the like as a temperature parameter.

Further, according to the above described Embodiment 1, in a low-rotation and high-load region of the engine 10 with a supercharger, attention was focused, in particular, on a tendency with respect to the ease with which pre-ignition occurs, and this region was described as the pre-ignition susceptibility operating region A. However, the present invention is not limited thereto, and the present invention also includes a configuration that, with respect to an engine that adopts another system or the like, if a tendency exists such that pre-ignition is susceptible to occur in a specific operating region, controls the cylinder wall temperature based on the pre-ignition occurrence frequency in that operating region.

In addition, in the above described Embodiment 1, a case was exemplified in which, in the flowchart illustrated in FIG. 8, cylinder wall temperature control that decreases the cooling water amount of the engine is executed only in a case where the cylinder wall temperature t is a low temperature (less than the temperature lower limit value t1). However, the present invention is not limited thereto, and in a case where the cylinder wall temperature t is a high temperature also (greater than or equal to the temperature upper limit value t2), for example, immediately after step 110 in FIG. 8 or the like, cylinder wall temperature control may be executed that increases the cooling water amount of the engine.

Embodiment 2

Figure 9:
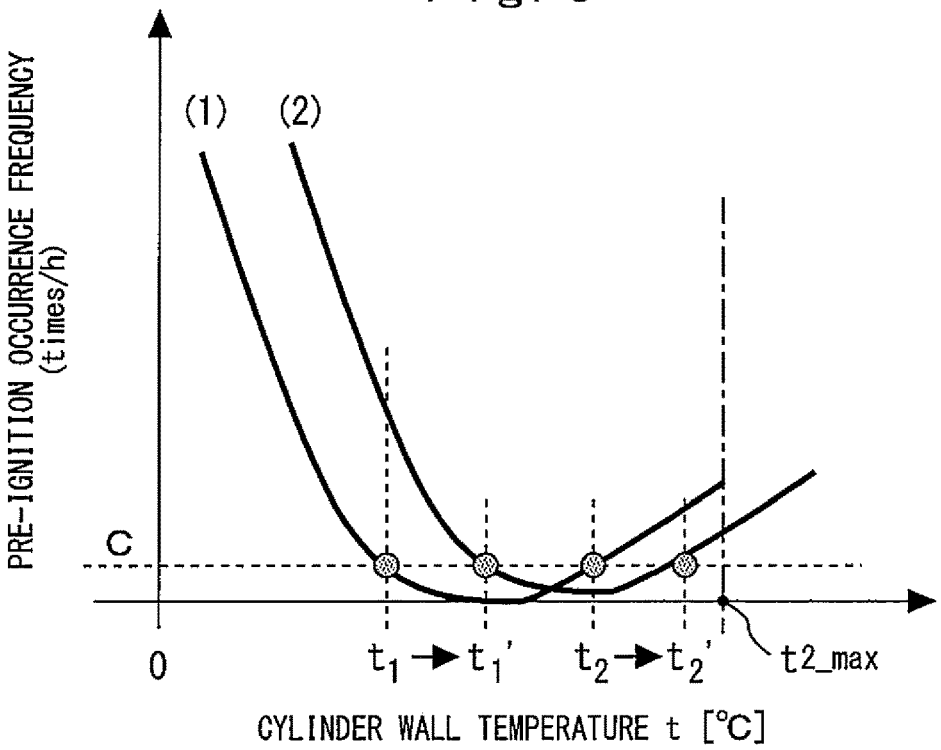
FIG. 9 is a characteristic diagram that illustrates a case where the pre-ignition suppression temperature region was shifted towards the high temperature side due to a change in the fuel properties or the like in Embodiment 2 of the present invention.

Next, Embodiment 2 of the present invention will be described with reference to FIGS. 9 to 11. A feature of the present embodiment is that, in addition to having a similar configuration and executing similar control to the above described Embodiment 1, control is performed to adapt to a case in which the fuel properties have changed. Note that, according to the present embodiment, components that are the same as in Embodiment 1 are denoted by the same reference symbols, and a description of such components is omitted hereunder.

Features of Embodiment 2

As described in the foregoing, particularly at the time of a low temperature, the relation between a cylinder wall temperature and the pre-ignition occurrence frequency is significantly influenced by the state with respect to the occurrence of fuel dilution (fuel volatilization characteristic). That is, because the characteristic lines (temperature lower limit value t1 and temperature upper limit value t2) shown in the above described FIG. 4 are obtained based on a fixed reference state such as, for example, a case of gasoline (the alcohol concentration in the fuel is zero), there is a concern that the characteristic lines shown in FIG. 4 will be changed by the fuel properties (degree of heaviness or lightness of the fuel, the alcohol concentration or amount of impurities in the fuel, and the like), and that consequently it will not be possible to appropriately control the cylinder wall temperature.

Therefore, according to the present embodiment, the pre-ignition occurrence frequency is detected in the pre-ignition suppression temperature region (particularly, at the temperature lower limit value t1 and the temperature upper limit value t2). If the occurrence frequency exceeds a criteria (permissible limit from a practical viewpoint) C, the pre-ignition suppression temperature region is shifted and the cylinder temperature t is then controlled so as to fall within the pre-ignition suppression temperature region. More specifically, FIG. 9 is a characteristic diagram that illustrates a case where the pre-ignition suppression temperature region was shifted towards the high temperature side due to a change in the fuel properties or the like in Embodiment 2 of the present invention. In FIG. 9, characteristic line (1) illustrates the relation between the pre-ignition occurrence frequency and the cylinder wall temperature in a case where a certain fuel (for example, a fuel in which the alcohol concentration is a fixed reference value) that serves as a standard is used (a base state). On the other hand, characteristic line (2), for example, illustrates a state in which, because the alcohol concentration is high relative to the base state, the pre-ignition suppression temperature region changed to the high temperature side.

In a case where a pre-ignition occurrence frequency characteristic changed in the manner indicated by the characteristic line (2), even if the cylinder temperature t is controlled to a temperature value that was appropriate up to the time that the pre-ignition occurrence frequency characteristic changed (the temperature lower limit value t1), the occurrence frequency will exceed the criteria C. In particular, a situation in which the pre-ignition occurrence frequency exceeds the criteria C at the temperature lower limit value t1 is liable to occur at a time of transient operation immediately upon entering the pre-ignition susceptibility operating region A after cold starting of the engine (a time of low-temperature starting). Therefore, according to the temperature region correction control, the pre-ignition suppression temperature region is corrected based on the relationship between the pre-ignition occurrence frequency and the cylinder wall temperature t, and a temperature region in which the occurrence frequency does not exceed the criteria C (for example, t1' to t2') is set as a new pre-ignition suppression temperature region.

More specifically, in a case where the pre-ignition occurrence frequency exceeds the criteria C at the temperature lower limit value t1, the temperature lower limit value t1 is shifted in a direction in which the occurrence frequency decreases (shifted towards the high temperature side). Note that, in the above description, a case has been exemplified in which the occurrence frequency exceeds the criteria C at the temperature lower limit value t1 and the temperature upper limit value t2. However, according to the temperature region correction control, similarly to the case where the occurrence frequency exceeds the criteria C, with respect to an arbitrary temperature in the pre-ignition suppression temperature region, the pre-ignition suppression temperature region may be shifted to the high temperature side or the low temperature side so that at least the occurrence frequency at the relevant temperature is equal to or less than the criteria C. Further, the relation between the pre-ignition occurrence frequency and the cylinder wall temperature t may also be previously stored in the ECU 50 as a plurality of data items that differ for each fuel property.

Figure 10:
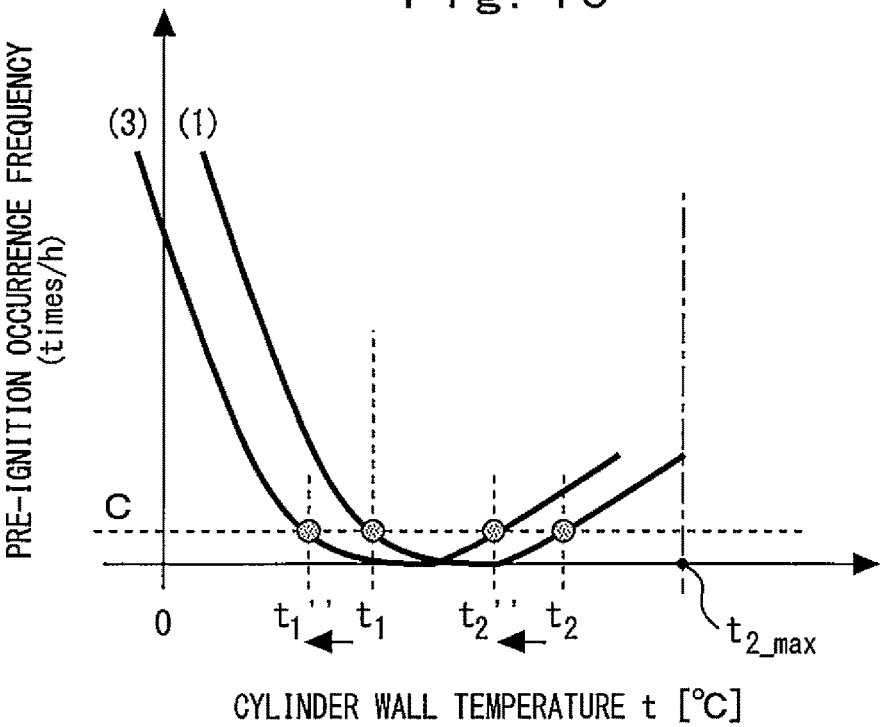
FIG. 10 is a characteristic diagram illustrating a case where the pre-ignition suppression temperature region was shifted to the low temperature side due to a change in the fuel properties or the like according to Embodiment 2 of the present invention.

On the other hand, FIG. 10 is a characteristic diagram illustrating a case where the pre-ignition suppression temperature region was shifted to the low temperature side due to a change in the fuel properties or the like according to Embodiment 2 of the present invention. In FIG. 10, a characteristic line (3) indicates a state in which, for example, because the alcohol concentration in the fuel is low in comparison to the above described characteristic line (1), the pre-ignition suppression temperature region changed toward the low temperature side. In this case, even if the cylinder temperature t is controlled to a temperature value that was appropriate up to the time that the pre-ignition occurrence frequency characteristic changed (temperature upper limit value t2), the occurrence frequency will exceed the criteria C. Therefore, according to the temperature region correction control, the pre-ignition suppression temperature region is corrected based on the relationship between the pre-ignition occurrence frequency and the cylinder wall temperature t, and a temperature region in which the occurrence frequency does not exceed the criteria C (for example, t1" to t2") is set as a new pre-ignition suppression temperature region.

Note that, the control operation described in FIG. 10 is also executed in a case where the value of the pre-ignition occurrence frequency at the temperature lower limit value t1 includes a margin with respect to the criteria C, that is, when the occurrence frequency at a time of a low temperature is smaller than the criteria C. In this case, the ECU 50 determines that the pre-ignition occurrence frequency is of a level that does not constitute a problem even in the low temperature region, and shifts each of the temperature lower limit value t1 and the temperature upper limit value t2 to the low temperature side. In addition, after the temperature region correction control has been executed, the above described cylinder wall temperature control is executed to control the cylinder wall temperature t so that the actual cylinder wall temperature t falls within the corrected pre-ignition suppression temperature region (for example, t1' to t2' or t1" to t2").

(Pre-Ignition Detection Means)

Pre-ignition detection means will now be described. For example, a cylinder pressure sensor (CPS) and a knock sensor (KCS) are known as means for detecting the occurrence of pre-ignition. As shown in the above described FIG. 3, the CPS performs a detection operation utilizing the fact that the maximum cylinder pressure Pmax becomes extremely large when pre-ignition occurs. Further, as shown in FIG. 3, the KCS performs a detection operation utilizing the fact that a characteristic frequency component arises when pre-ignition occurs. In addition, a method is also known that utilizes a fact that an ion current flows between the electrodes of a spark plug when pre-ignition occurs to detect the occurrence of pre-ignition by means of the behavior of the ion current.

Specific Processing to Realize Embodiment 2

Next, specific processing for implementing the above described control is described with reference to FIG. 11. FIG. 11 is a flowchart that illustrates control that is executed by the ECU according to Embodiment 2 of the present invention. It is assumed that the routine shown in FIG. 11 is repeatedly executed during operation of the engine. In the routine shown in FIG. 11, first, in step 200, the ECU 50 determines whether or not the actual operating region of the engine is within the pre-ignition susceptibility operating region A. In step 202, the ECU 50 measures the pre-ignition occurrence frequency. Next, in step 204, the ECU 50 executes temperature region correction control, and corrects the pre-ignition suppression temperature region based on changes in the pre-ignition occurrence frequency with respect to the base state. Note that a method of measuring the pre-ignition occurrence frequency is described later. Next, in steps 206 to 216, the ECU 50 executes similar processing to that in steps 102 to 110 in Embodiment 1 (FIG. 8), and as necessary executes the cylinder wall temperature control and the pre-ignition suppression control.

Thus, according to the present embodiment that is configured in this manner also, substantially the same actions and effects as in the foregoing Embodiment 1 can be obtained. Further, in particular, according to the temperature region correction control, for example, even if the pre-ignition suppression temperature region ($t1 \leq t \leq t2$) in a base state (before correction) deviates from an optimal region due to changes in the fuel properties or changes over time in the pre-ignition occurrence frequency or the like, a temperature region ($t1' \leq t \leq t2'$) after correction can be adjusted to the optimal region based on the actual pre-ignition occurrence frequency. That is, even in a case where the appropriate temperature region for minimizing the occurrence of pre-ignition changes due to external factors, the temperature lower limit value t1 and the temperature upper limit value t2 can be corrected to appropriate temperatures. Accordingly, an influence due to changes in the fuel properties or deterioration over time in equipment can be absorbed by means of the temperature region correction control, and the cylinder wall temperature control can be appropriately executed. Furthermore, without using a special mechanism or sensor or the like for detecting changes over time in the fuel properties and engine characteristics, temperature region correction control can be executed taking only the pre-ignition occurrence frequency as a parameter, and hence the system can be simplified and a reduction in cost can be facilitated.

Figure 11:
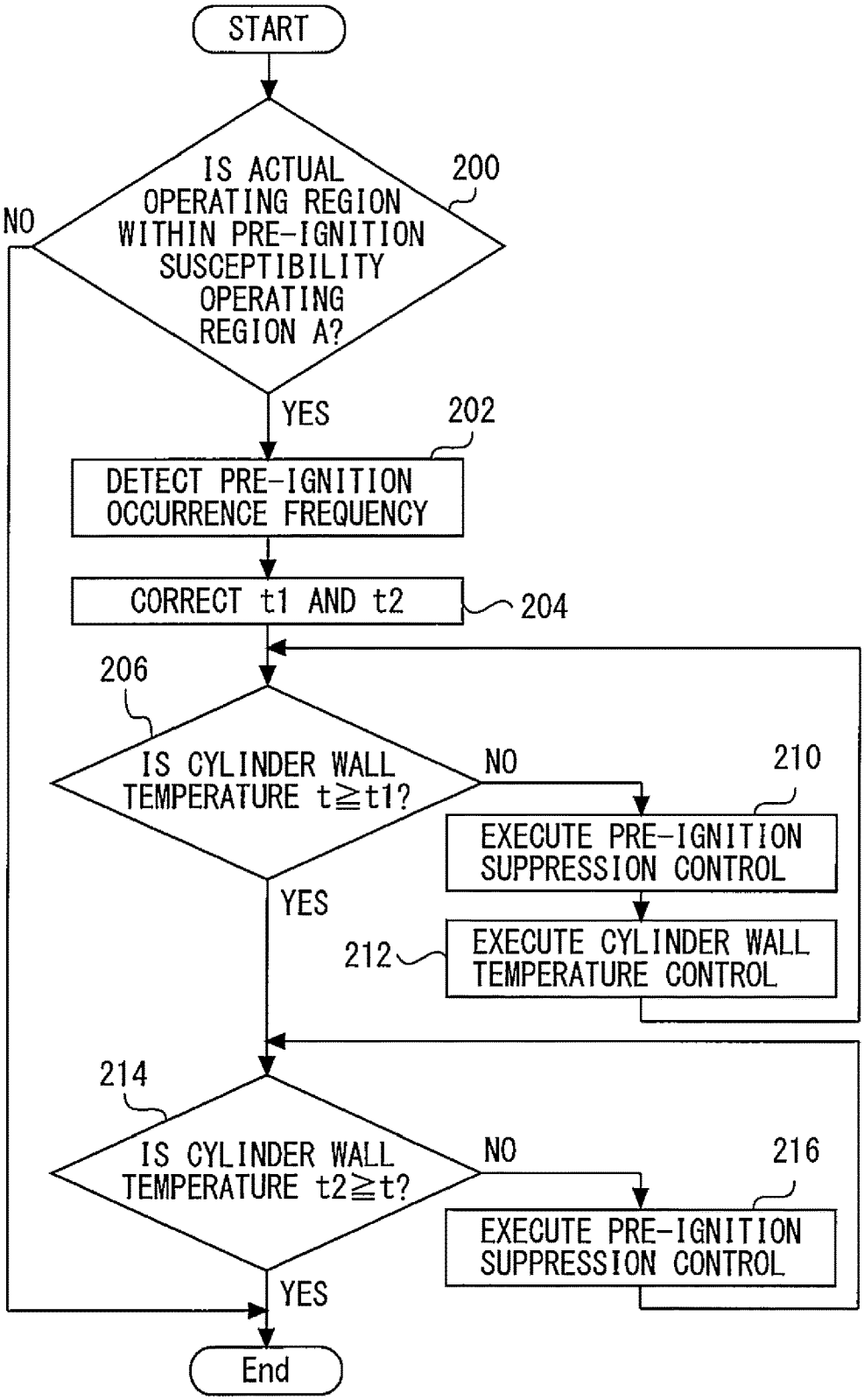
FIG. 11 is a flowchart that illustrates control that is executed by the ECU according to Embodiment 2 of the present invention.

Note that, in the above described Embodiment 2, step 202 in FIG. 11 represents a specific example of occurrence frequency detection means according to claim 6, and step 204 in FIG. 11 represents a specific example of temperature region varying means. The specific examples of such means are the same as described in FIG. 8. Further, t2_max that is described in FIG. 9 and FIG. 10 exemplifies a highest realizable temperature of the cylinder wall temperature that is restricted by the structure of the engine and the like. Further, in the above described Embodiment 2, in the case of changing (shifting) the temperature lower limit value t1 and the temperature upper limit value t2 by means of the temperature region correction control, the shifts amounts of both values may be set equally or may be set differently.

Embodiment 3

Figure 12:
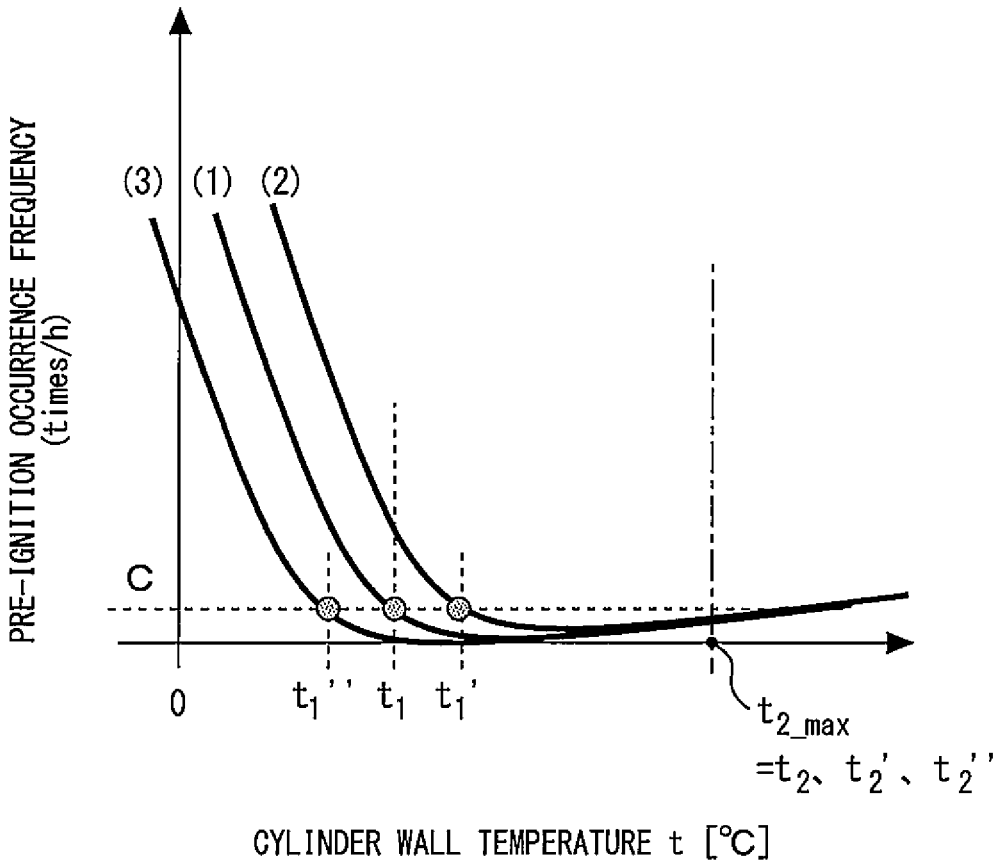

Next, Embodiment 3 of the present invention will be described with reference to FIG. 12. A feature of the present embodiment is that, while adopting a similar configuration and similar control as in the above described Embodiment 1, according to the present embodiment only the temperature lower limit value of the pre-ignition suppression temperature region is made variable. Note that, according to the present embodiment, components that are the same as in Embodiment 1 are denoted by the same reference symbols, and a description of such components is omitted hereunder.

Features of Embodiment 3

It is originally preferable that the temperature upper limit value t2 of the pre-ignition suppression temperature region is set based on the pre-ignition occurrence frequency. However, for example, depending on the structural characteristics of the engine or the ambient temperature environment (heat resistance and the like), in some cases it is difficult to shift the cylinder wall temperature t further to the high temperature side than the temperature upper limit value t2. Therefore, according to the present embodiment, control that addresses such a case is described. FIG. 12 is a characteristic diagram that illustrates a case in which, in Embodiment 3 of the present invention, the pre-ignition suppression temperature region is shifted to the low temperature side because of changes in the fuel properties or the like. According to the present embodiment, when the pre-ignition occurrence frequency exceeds the criteria C in the pre-ignition suppression temperature region, only the temperature lower limit value t1 is shifted to the high temperature side or the low temperature side. This shifting operation is executed by the cooling water amount varying mechanism 38 and is the same as in Embodiment 2. Further, in a case where the cylinder wall temperature t has deviated to the low temperature side or the high temperature side from the pre-ignition suppression temperature region A, the aforementioned pre-ignition suppression control is executed.

On the other hand, regardless of whether or not the occurrence frequency exceeds the criteria C, the temperature upper limit value t2 is held at the aforementioned highest temperature t2_max. That is, t2' and t2" of Embodiment 2 are set equally at the highest temperature t2_max. Further, the highest temperature t2_max that is the criteria temperature of the cylinder wall temperature is set so that the pre-ignition occurrence frequency at the relevant temperature does not exceed the criteria C. This setting is realized, for example, by devising appropriate modifications for the hardware configuration such as the engine cooling system. Note that, in order to specifically implement the control of Embodiment 3, it is sufficient to adopt a configuration that, in step 204 of the above described Embodiment 2 (FIG. 11), changes only the temperature lower limit value t1 and maintains the temperature upper limit value at t2_max. According to the present embodiment configured in this manner also, substantially the same actions and effects as in the above described Embodiment 1 can be obtained. In particular, according to the present embodiment, the cylinder wall temperature can be appropriately controlled in accordance with the hardware configuration of the engine.

Embodiment 4

Figure 13:
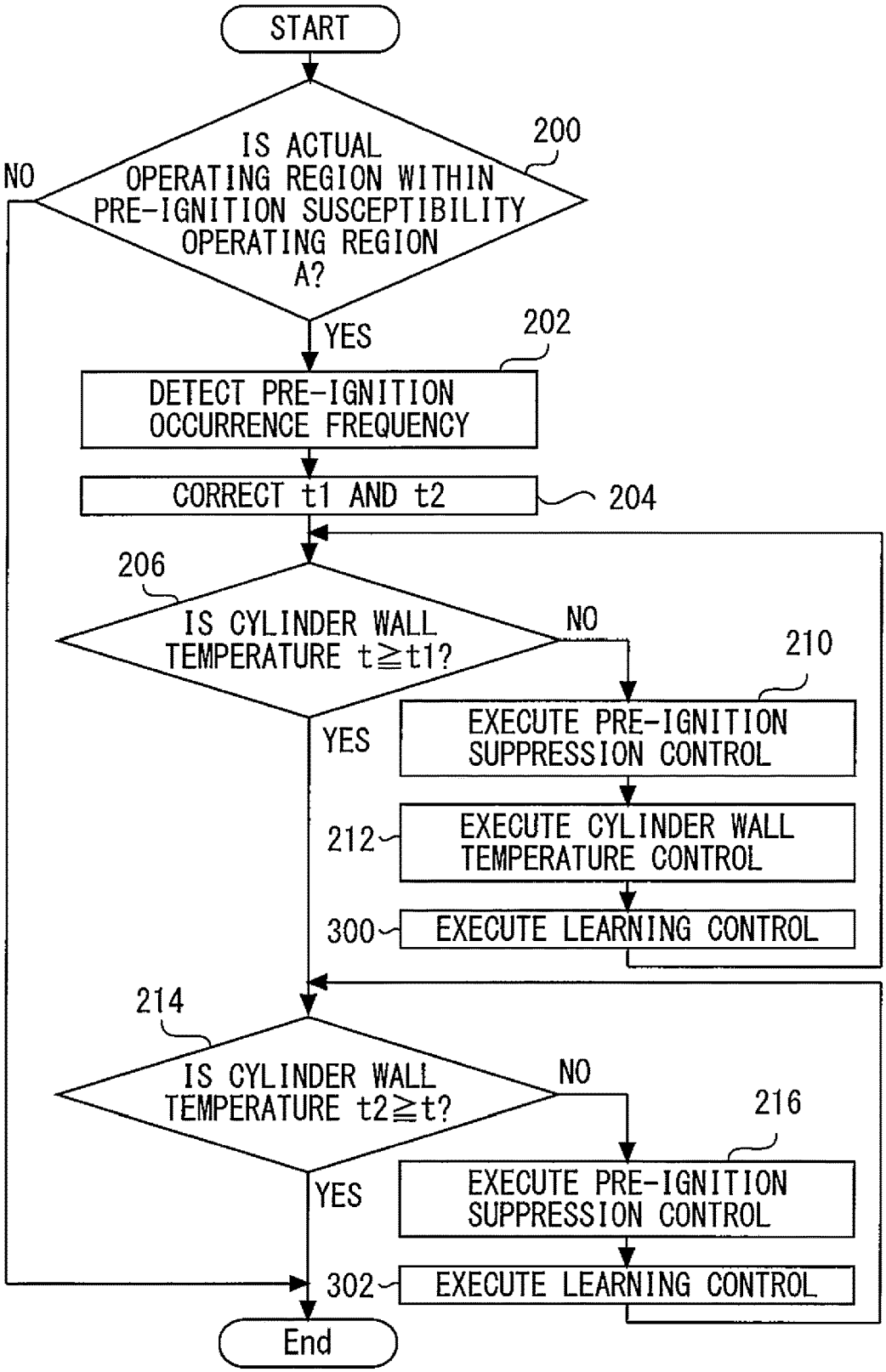
FIG. 13 is a flowchart that illustrates control that is executed by the ECU according to Embodiment 4 of the present invention.

Next, Embodiment 4 of the present invention will be described with reference to FIG. 13. A feature of the present embodiment is that, while adopting a similar configuration and similar control as in the above described Embodiment 1, according to the present embodiment the relation between the pre-ignition occurrence frequency and the cylinder wall temperature is learned based on the fuel properties and changes in the environment. Note that, according to the present embodiment, components that are the same as in Embodiment 1 are denoted by the same reference symbols, and a description of such components is omitted hereunder.

Features of Embodiment 4

In the learning control, the ECU 50 detects the pre-ignition occurrence frequency and learns the relation between the occurrence frequency and temperature region at a time that the temperature lower limit value t1 and the temperature upper limit value t2 change. As a specific example, it is assumed that, first, in a previously set base state, the cylinder temperature t is realized with a specific cooling water amount w. Here, for example, in a case where the pre-ignition occurrence frequency increases due to a change arising in the fuel properties or the like, the cooling water amount is decreased by the cylinder wall temperature control to increase the cylinder wall temperature and thereby decrease the occurrence frequency. Further, at a time that the pre-ignition occurrence frequency decreases to equal to or less than the criteria C, the ECU 50 learns the cylinder wall temperature (relation between the cylinder wall temperature and pre-ignition occurrence frequency) at that time. Further, the result of the learning control is stored in the ECU 50 by, for example, updating the data that is stored for the characteristic lines illustrated in FIG. 4, FIG. 9, FIG. 10 and the like.

Specific Processing to Realize Embodiment 4

Next, specific processing for implementing the above described control is described with reference to FIG. 13. FIG. 13 is a flowchart that illustrates control that is executed by the ECU according to Embodiment 4 of the present invention. It is assumed that the routine shown in FIG. 13 is repeatedly executed during operation of the engine. The routine shown in FIG. 13 is a routine in which learning control that is executed in steps 300 and 302 is added to the routine of the above described Embodiment 2 (FIG. 11).

Substantially the same actions and effects as in the foregoing Embodiments 1 to 3 can also be obtained according the present embodiment that is configured as described above. Further, according to the present embodiment, by performing learning control, for example, it is possible to flexibly address changes in the fuel properties and changes over time in the engine, and therefore, even if such changes arise, the cylinder wall temperature can be appropriately controlled and the occurrence of pre-ignition can be suppressed.

Embodiment 5

Figure 15:
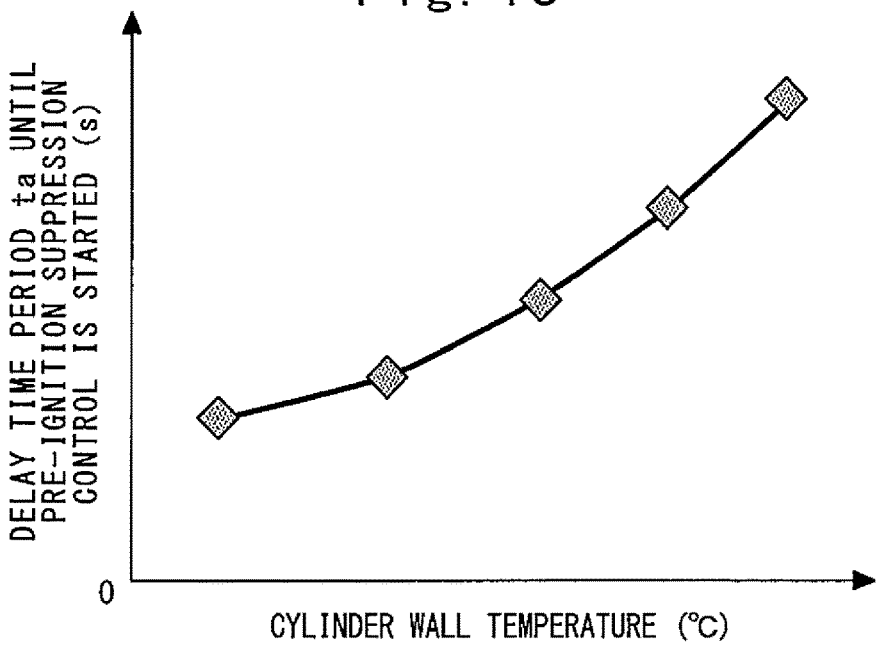
FIG. 15 is a characteristic diagram for setting a delay time period ta of the pre-ignition suppression control based on the entry-time cylinder temperature t.
Figure 16:
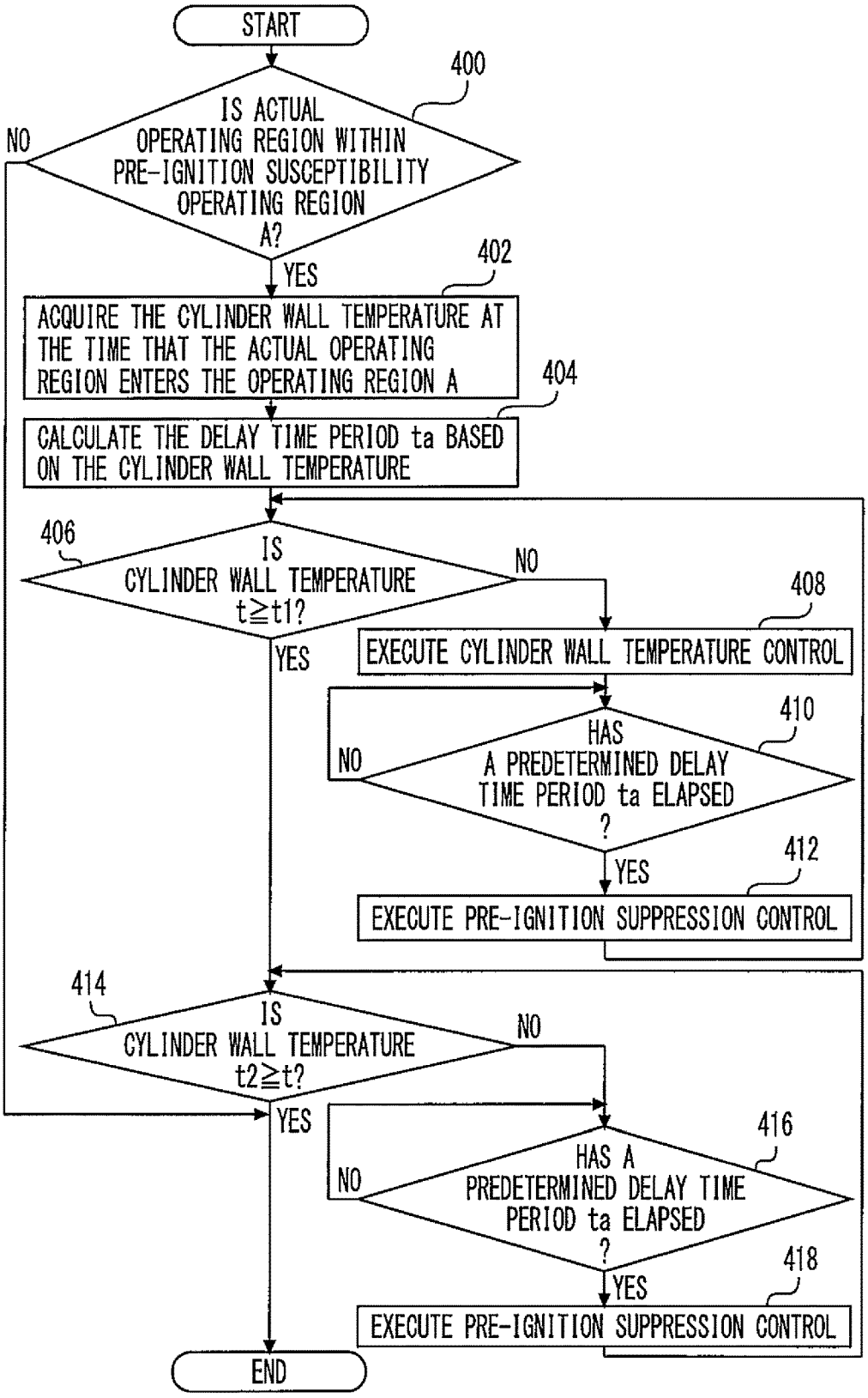
FIG. 16 is a flowchart that illustrates control that is executed by the ECU according to Embodiment 5 of the present invention.

Next, Embodiment 5 of the present invention is described with reference to FIG. 14 to FIG. 16. A feature of the present embodiment is that, while adopting a similar configuration and similar control as in the above described Embodiment 1, in the case of executing pre-ignition suppression control, the timing for starting control is delayed in accordance with the cylinder wall temperature. Note that, according to the present embodiment, components that are the same as in Embodiment 1 are denoted by the same reference symbols, and a description of such components is omitted hereunder.

Figure 14:
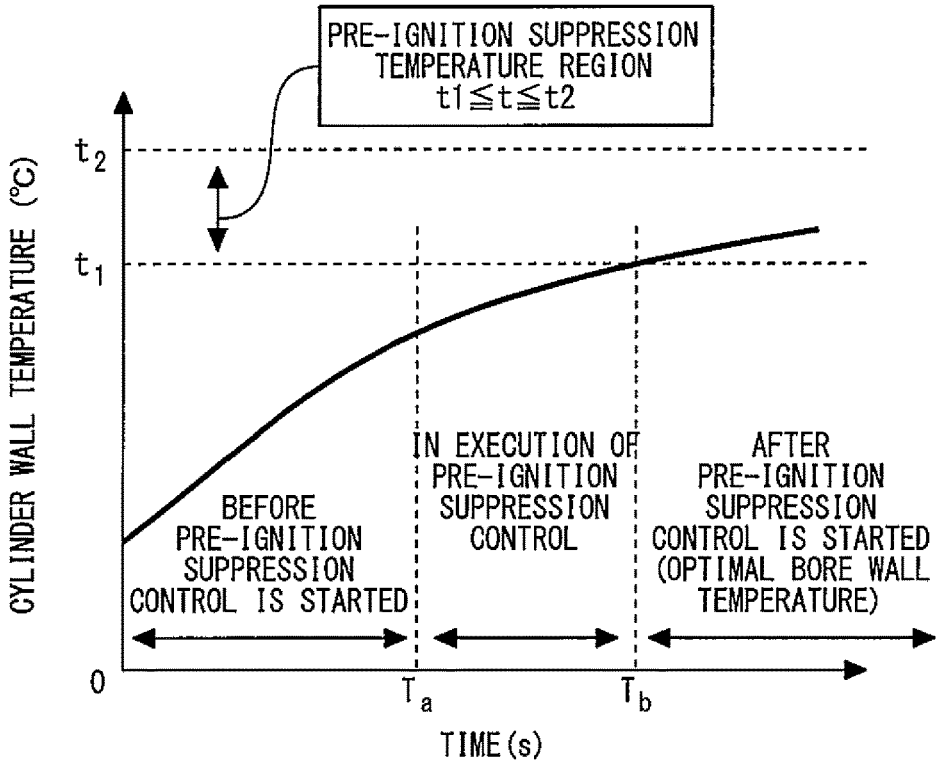
FIG. 14 is an explanatory view that illustrates the manner in which, in Embodiment 5 of the present invention, the cylinder wall temperature t rises from the low temperature region to the pre-ignition suppression temperature region as a result of cold-starting the engine.

FIG. 14 is an explanatory view that illustrates the manner in which, in Embodiment 5 of the present invention, the cylinder wall temperature t rises from the low temperature region to the pre-ignition suppression temperature region as a result of cold-starting the engine. As described above, in the pre-ignition susceptibility operating region A, during a time period (0 to Ta to Tb) until the wall surface temperature t reaches the temperature lower limit value t1, cylinder wall surface control that reduces the cooling water amount of the engine, and pre-ignition suppression control that is implemented by enriching the A/F and reducing the torque are executed. However, because the pre-ignition suppression control changes the operating state of the internal combustion engine and is liable to affect the driving performance and exhaust emissions, it is preferable to avoid executing the pre-ignition suppression control for an extended time period.

Therefore, according to the present embodiment, in a case where pre-ignition suppression control is first performed after cold starting of the engine, control (suppression delay control) is executed so that, the higher that the cylinder wall temperature t is at the time point at which the actual operating region enters the pre-ignition susceptibility operating region A (hereunder, referred to as "entry-time cylinder temperature t"), the more that a start timing Ta of the pre-ignition suppression control is delayed. FIG. 15 is a characteristic diagram for setting a delay time period ta of the pre-ignition suppression control based on the entry-time cylinder temperature t. This characteristic diagram is previously stored in the ECU 50. As shown in FIG. 15, a delay time period ta from when the actual operating region enters the pre-ignition susceptibility operating region A until pre-ignition suppression control is started (corresponds to start timing Ta of same control) is previously set so as to increase as the entry-time cylinder temperature t rises. The delay time period ta is set in this manner for the following reasons.

First, the premise for the following description will be described. In a low temperature region, since it is basically difficult for fuel to evaporate, there is a tendency for the oil dilution ratio to increase and pre-ignition is liable to occur.

However, in a low temperature region, because the cylinder temperature is low, it is difficult for ignition to occur even if a fire source exists in the form of scattered oil droplets. Therefore, the pre-ignition occurrence frequency is determined in accordance with a balance between these two factors. Accordingly, if the balance between the two factors is lost due to an increase in the cylinder wall temperature (cylinder temperature) or the like, the pre-ignition occurrence frequency will rapidly increase from a certain temperature.

On the other hand, in a case where the cylinder wall temperature is lower than the temperature lower limit value T1, although pre-ignition suppression control is executed, as described in the foregoing, the pre-ignition suppression control affects the driving performance and the like of the vehicle. However, even in a low temperature region, when the cylinder wall temperature is near to the pre-ignition suppression temperature region (temperature lower limit value t1), there are many cases in which the engine does not necessarily require pre-ignition suppression control. The reason is that, as shown in the above described FIG. 4, the pre-ignition occurrence frequency decreases in the vicinity of the pre-ignition suppression temperature region.

Consequently, according to the suppression delay control, in the low temperature region, the higher than the entry-time cylinder temperature t is, that is, the closer that the entry-time cylinder temperature t is to the pre-ignition suppression temperature region, the more that the start timing Ta of the pre-ignition suppression control is delayed and the execution time period thereof is shortened. In other words, in the low temperature region, the higher that the cylinder wall temperature t is, the more difficult it is for pre-ignition to occur, and therefore a configuration is adopted so as to lengthen a control standby time period to so as to delay execution of the pre-ignition suppression control as much as possible. On the other hand, according to the suppression delay control, in the low temperature region, the lower that the entry-time cylinder temperature t is, the earlier that the start timing Ta for the pre-ignition suppression control is made so as to thereby lengthen the execution time period of the pre-ignition suppression control. In other words, in this case, since pre-ignition is liable to occur at the time that the actual operating region enters the pre-ignition susceptibility operating region A, the pre-ignition suppression control is executed from as early a stage as possible.

The present embodiment configured in this manner also provides substantially the same actions and effects as in Embodiment 1. In particular, by means of the suppression delay control, since the start timing of the pre-ignition suppression control can be delayed in accordance with the cylinder wall temperature at the time that the actual operating region enters the pre-ignition susceptibility operating region A, the driving performance and exhaust emission performance of the engine can be secured while suppressing the pre-ignition occurrence frequency.

Specific Processing to Realize Embodiment 5

Next, specific processing for implementing the above described control is described with reference to FIG. 16. FIG. 16 is a flowchart that illustrates control that is executed by the ECU according to Embodiment 5 of the present invention. It is assumed that the routine shown in FIG. 16 is repeatedly executed during operation of the engine. In the routine shown in FIG. 16, first, in step 400, the ECU 50 determines whether or not the actual operating region is within the pre-ignition susceptibility operating region A. If the result determined in step 400 is negative, the ECU 50 ends the present routine. In contrast, if the result determined in step 400 is affirmative, in step 402 the ECU 50 acquires the entry-time cylinder temperature t that is the cylinder wall temperature at the time that the actual operating region enters the operating region A. Next, in step 404, based on, for example, the characteristic line shown in FIG. 15, the ECU 50 calculates the delay time period ta on the basis of the entry-time cylinder temperature t.

Next, in step 406, in a substantially similar manner to Embodiment 1 (FIG. 8), the ECU 50 determines whether or not the cylinder wall temperature t is in the low temperature region. Subsequently, if the cylinder wall temperature t is in the low temperature region, in step 408, the ECU 50 executes the above described cylinder wall temperature control. Further, in step 410, the ECU 50 determines whether or not a predetermined delay time period ta has elapsed since entering the pre-ignition susceptibility operating region A, and stands by until the time period elapses. Next, in step 412, after the delay time period ta has elapsed, the ECU 50 executes the pre-ignition suppression control.

On the other hand, if the result determined in step 406 is negative, in step 414, the ECU 50 determines whether or not the cylinder wall temperature t is in the high temperature region. If the cylinder wall temperature t is in the high temperature region, in step 416, the ECU 50 determines whether or not the predetermined delay time period ta has elapsed since entering the pre-ignition susceptibility operating region A, and stands by until the time period elapses. Next, in step 418, the ECU 50 executes the pre-ignition suppression control. Further, if the results determined in both of steps 406 and 414 are affirmative, since the cylinder wall temperature t is within the pre-ignition suppression temperature region, the ECU 50 determines that the wall temperature in question is being appropriately controlled, and thus ends the control. Note that, in the above described Embodiment 5, steps 410 and 416 in FIG. 16 and the characteristic diagram in FIG. 15 represent a specific example of delay means according to claim 4.

Embodiment 6

Next, Embodiment 6 of the present invention will be described with reference to FIG. 17. A feature of the present embodiment is that, while adopting the same control as in the above described Embodiment 5, according to the present embodiment a relation between the entry-time cylinder wall temperature and the delay time period of the pre-ignition suppression control is learned. Note that, according to the present embodiment, components that are the same as in Embodiment 5 are denoted by the same reference symbols, and a description of such components is omitted hereunder.

Figure 17:
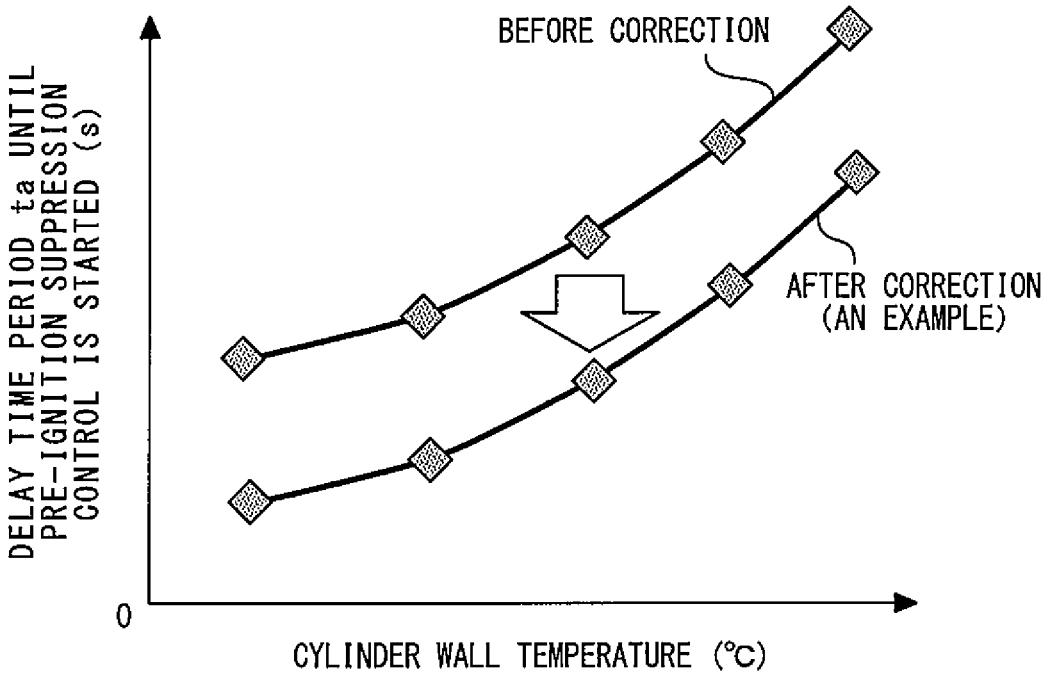
FIG. 17 is an explanatory drawing that illustrates correction control that corrects a relationship between the entry-time cylinder temperature t and the delay time period ta of pre-ignition suppression control in Embodiment 6 of the present invention.

FIG. 17 is an explanatory drawing that illustrates correction control that corrects a relationship between the entry-time cylinder temperature t and the delay time period ta of pre-ignition suppression control in Embodiment 6 of the present invention. As shown in FIG. 17, according to the present embodiment, based on the pre-ignition occurrence state, delay correction control is executed that updates characteristic data that represents a relation between the entry-time cylinder temperature t and the above described delay time period ta. According to the delay correction control, for example, in a case where pre-ignition occurred before the start of pre-ignition suppression control, as illustrated in the example shown in FIG. 17, the relation between the entry-time cylinder temperature t and the delay time period ta is corrected so as to shorten the delay time period ta (control start time Ta is made earlier) with respect to a certain cylinder wall temperature t. Further, the correction result (characteristic line after correction) is stored as a learning result.

Substantially the same actions and effects as in the foregoing Embodiments 1 and 6 can be obtained according to the present embodiment configured in this manner also. In particular, according to the present embodiment, a relation between the entry-time cylinder temperature t and the above described delay time period ta that arises due to changes over time in the engine and the like can be learned based on the pre-ignition occurrence state. Note that, according to the above described Embodiment 6, the characteristic diagram exemplified in FIG. 17 represents a specific example of delay correction means according to claim 5.

DESCRIPTION OF REFERENCE NUMERALS

10 engine (internal combustion engine), 12 piston, 14 combustion chamber, 16 crankshaft, 18 intake passage, 20 exhaust passage, 22 throttle valve, 24 intercooler, 26 exhaust purification catalyst, 28 fuel injection valve, 30 spark plug, 32 intake valve, 34 exhaust valve, 36 turbosupercharger, 38 cooling water amount varying mechanism (cylinder wall temperature varying means), 40 crank angle sensor, 42 airflow sensor, 44 water temperature sensor (wall temperature parameter acquisition means), 46 cylinder pressure sensor (pre-ignition detection means), 50 ECU (pre-ignition temperature region storage means), A pre-ignition susceptibility operating region, t cylinder wall temperature, tw engine water temperature (wall temperature parameter), t1, t1', t1" temperature lower limit value, t2, t2', t2" temperature upper limit value, to delay time period

The invention claimed is:

1. A control device for an internal combustion engine, comprising:

wall temperature parameter acquisition unit for acquiring a cylinder wall temperature of an internal combustion engine or a parameter corresponding to the cylinder wall temperature as a wall temperature parameter;

cylinder wall temperature varying unit that is capable of changing the cylinder wall temperature;

pre-ignition temperature region storage unit in which a pre-ignition suppression temperature region in which a pre-ignition occurrence frequency decreases more than in a peripheral temperature region is previously stored, the pre-ignition suppression temperature region being a temperature region that is set based on a relation between a pre-ignition occurrence frequency and the cylinder wall temperature; and cylinder wall temperature control unit for, in response to an actual operating region that is a region in which the internal combustion engine is actually operating being within a predetermined pre-ignition susceptibility operating region, performing control using the cylinder wall temperature varying unit so that the wall temperature parameter falls within the pre-ignition suppression temperature region;

wherein the cylinder wall temperature control unit is configured to raise the wall temperature parameter in response to the wall temperature parameter being lower than the pre-ignition suppression temperature region, and configured to decrease the wall temperature parameter in response to the wall temperature parameter being higher than the pre-ignition suppression temperature region.

2. The control device for an internal combustion engine according to claim 1, wherein:

the cylinder wall temperature varying unit comprises a cooling water amount varying mechanism that adjusts a cooling water amount that is supplied to the internal combustion engine; and the cylinder wall temperature control unit is configured so that, in response to the wall temperature parameter deviating from the pre-ignition suppression temperature region, the cylinder wall temperature control unit causes the wall temperature parameter to fall within the pre-ignition suppression temperature region by changing the cooling water amount using the cooling water amount varying mechanism.

3. The control device for an internal combustion engine according to claim 1, comprising:

pre-ignition suppression unit for, in response to the wall temperature parameter deviating from the pre-ignition suppression temperature region in a state in which the actual operating region is within the pre-ignition susceptibility operating region, changing an operating state of the internal combustion engine to suppress occurrence of pre-ignition.

4. The control device for an internal combustion engine according to claim 3, comprising:

a delay unit for, in response to the pre-ignition suppression unit first operating after cold starting of the internal combustion engine, delaying an operation start timing of the pre-ignition suppression unit in a manner such that the higher that the wall temperature parameter is at a time point at which the actual operating region enters the pre-ignition susceptibility operating region, the more that the operation start timing is delayed.

5. The control device for an internal combustion engine according to claim 4, comprising:

pre-ignition detection unit for detecting an occurrence of pre-ignition; and delay correction unit for, in response to pre-ignition occurring before operation of the pre-ignition suppression unit starts, correcting a relation between the wall temperature parameter and the operation start timing so that the operation start timing becomes earlier.

6. The control device for an internal combustion engine according to claim 1, comprising:

occurrence frequency detection unit for detecting an occurrence frequency that is a frequency at which pre-ignition occurs per unit of time; and temperature region varying unit for variably setting a range of the pre-ignition suppression temperature region in response to the pre-ignition occurrence frequency exceeding a permissible limit.

7. The control device for an internal combustion engine according to claim 1, comprising:

a supercharger that supercharges intake air utilizing an exhaust pressure;

wherein the pre-ignition susceptibility operating region is a low-rotation and high-load region.

8. A control device for an internal combustion engine, comprising:

a wall temperature parameter acquisition unit for acquiring a cylinder wall temperature of an internal combustion engine or a parameter corresponding to the cylinder wall temperature as a wall temperature parameter;

a cylinder wall temperature varying unit that is capable of changing the cylinder wall temperature;

a pre-ignition temperature region storage unit that previously stores a pre-ignition suppression temperature region that is set based on a relationship between a pre-ignition occurrence frequency and the cylinder wall temperature and is set as a temperature region in which the pre-ignition occurrence frequency decreases to a permissible limit or lower; and a cylinder wall temperature control unit for, in response to an actual operating region that is a region in which the internal combustion engine is actually operating being within a predetermined pre-ignition susceptibility operating region, performing control using the cylinder wall temperature varying unit so that the wall temperature parameter falls within the pre-ignition suppression temperature region, wherein the cylinder wall temperature control unit is configured to:

raise, in response to an acquisition value of the wall temperature parameter acquired by the wall temperature parameter acquisition unit being lower than the pre-ignition suppression temperature region, the actual cylinder wall temperature by using the cylinder wall temperature varying unit such that the acquisition value increases to a temperature that falls within the pre-ignition suppression temperature region; and in response to the acquisition value of the wall temperature parameter acquired by the wall temperature parameter acquisition unit being higher than the pre-ignition suppression temperature region, the actual cylinder wall temperature by using the cylinder wall temperature varying unit such that the acquisition value decreases to a temperature that falls within the pre-ignition suppression temperature region.

* * * * *